US006073775A

United States Patent [19]

Liu

[11] Patent Number: 6,073,775

[45] Date of Patent: Jun. 13, 2000

[54] CYCLONIC-STATIC MICRO-BUBBLE FLOATATION APPARATUS AND METHOD

[76] Inventor: Jiongtian Liu, No.1-701, Bldg. 21, Meijian West Village, Meijian Rd., Xuzhou, China

[21] Appl. No.: 09/232,992

[22] Filed: Jan. 19, 1999

[51] Int. Cl.[7] ..... B03D 1/14; B03D 1/24; B04C 3/00; B04C 5/00; B04C 9/00

[52] U.S. Cl. ..... 209/170; 209/168; 209/12.1; 209/725; 209/731; 261/123

[58] Field of Search ..... 209/170, 168, 209/12.1; 210/221.2; 261/123, DIG. 75

[56] References Cited

U.S. PATENT DOCUMENTS 3,842,004 10/1974 Nagahama .
4,152,888 5/1979 Flynn .
4,399,028 8/1983 Kile et al. .
4,592,834 6/1986 Yang .
4,721,562 1/1988 Barnscheidt et al. .
4,981,582 1/1991 Yoon et al. .
5,022,984 6/1991 Pimley et al. .
5,028,315 7/1991 Cruea et al. .
5,116,487 5/1992 Parekh et al. .
5,167,798 12/1992 Yoon et al. .
5,192,423 3/1993 Duczmal et al. .
5,746,910 5/1998 Negeri .
5,855,769 1/1999 Firth et al. .

*Primary Examiner*—Thomas M. Lithgow
*Attorney, Agent, or Firm*—Thomas R. Vigil

[57] ABSTRACT

A cyclonic-static micro-bubble flotation apparatus which includes a single unit flotation device having a cyclonic separation unit in the bottom portion of the device and a column flotation portion which includes packing in the upper portion of the flotation device.

26 Claims, 10 Drawing Sheets

V—V

W—W

CYCLONIC-STATIC MICRO-BUBBLE FLOATATION APPARATUS AND METHOD

BACKGROUND OF THE INVENTION

This invention relates to a floatation apparatus and method, more particularly to a cyclonic-static micro-bubble floatation apparatus and method in which the separation of fine materials is improved.

Conventional floatation columns operate based on the theory so called as "air bubble mineralization by reverse collision", which provide the floatation columns an effective separation method with high separating selectivity. Because of lacking a mechanism of improving the separation and increasing the recovery, the columns generally need increased separating zones, i.e., the highness of the columns is increased, in order to enhance the recovery. Therefore, conventional floatation columns usually have a highness of as long as 8–10 m or more and the separation efficiency and recovery capacity are low frequently.

Recently, the techniques used in the floatation column, especially the techniques for micro-bubble generation, have been greatly developed, and the quality of the bubbles generated in the columns can basically meet the requirement of the floatation column separation, and provide good conditions for the column's stable performance. Therefore, the low separation efficiency and recovery capacity presently emerge as the most noticeable problems of the conventional floatation columns, and perhaps directly limit their further development and wider application.

As above mentioned, the low separation efficiency and recovery capacity of the conventional floatation columns is due to lack of a mechanism of separation and recovery improvement. The following three new types of floatation columns with a reformed structure have been developed for enhancement of air bubble mineralization, and their separation efficiencies and recovery capacities have been improved to a certain extent but not sufficient.

For instance, in Eur. Pat. Appl. EP. 146,235 (C1.B03D1/14), Jun. 23, 1985 "Apparatus and method for removing foam and entrained particles from pulp in a floatation cell", a floatation column with a shorter shell body is disclosed, in which bubble mineralization in intense turbulent conditions within pipes is applied and the floatation efficiency is higher, but separation is not complete and the tailings contains a lot of the floatable minerals due to the insufficient mineralization time and lack of a multi-circulation processing for separation in the apparatus.

For instance, in U.S. Pat. No. 4,529,834, a packing floatation column is disclosed, in which the separation efficiency increases due to the packing media, but the column is readily plugged and clogged and then its production capacity decreases. In this kind of the floatation column, coarse particles are usually difficult to be recovered and often lost in the tailings.

For instance, in Microcell Column, a part of processed pulp is introduced from the floatation column as operating medium of the bubble generator, forming a pulp circulation. However, the circulating pulp and the tailings removed have not been further separated within the column, and the pulp passed the bubble generator has not been further processed by a pipe floatation to improve the separation efficiency.

The mechanical floatation machines have usually been designed based on application of the mechanism of improving separation. For example, at the bottom regions of the floatation machines around their mechanical agitator (including the regions under the agitator blade and around it), a high pulp turbulence conditions are formed, resulting in intense collision between mineral particles and air bubbles, and a high-degree mineralization of the bubbles from different directions is achieved. And there is a pulp circulation around the agitator within machines, increasing chances of the collision and mineralization. Although the mechanical agitation and pulp turbulence increases the mineralization efficiency and recovery capacity of the machines, they also deteriorate the conditions for separation of mineralized bubbles at the same time, resulting in serious mechanical entrainment of non-target minerals in the concentrate product.

For instance, in "Floatation Apparatus for Achieving Floatation in a Centrifugal Field, Miller, Jan D. Eur. Patent Appl. EP47, 135 (C1.BO3D/14), a cyclonic separator is used in the separation processing of fine materials, but this apparatus do not comprise any column separation apparatus. Although the separation speed in the apparatus has been increased, its separation selectivity becomes worse and the outstanding advantage of floatation columns disappears.

All above literature does not mention explicitly or implicitly the combination of the column separator and the cyclonic separator, the combination of the cyclonic separation and the pipe floatation, as well as the combination of the column separator, the cyclonic separator and the pipe floatation applied in mineral processing.

SUMMARY OF THE INVENTION

The object of the present invention is to overcome all above mentioned shortages of the conventional floatation apparatus, and to provide a new type of the floatation apparatuses and method with an excellent performance, that is, a higher separation efficiency, a lower column and a higher processing capacity. This floatation separation method takes full advantages of differences of density and surface properties among different minerals, and combines the cyclonic separation with the pipe floatation together to form a new separation mechanism of floatation-gravity concentration-floatation, which may much increase the separation efficiency and recovery. Then it combines this separation mechanism with the column separation method, which maintains the floatation column's merit of high separation selectivity and, at the same time, and overcomes its shortages of low efficiency and recovery capacity.

The task of this invention is fulfilled in the following ways, which will be illustrated with three embodiment, by which the invention can be accomplished.

1. The present invention provides a cyclonic-static micro-bubble floatation apparatus, which comprises:

a column separator; and a foam collecting device and a feed distribution device both installed at the upper portion of the column separator.

The said column separator includes a column and packing media within it; the column comprises an upper shell, a lower shell, a horn-like linking section connecting with the upper shell and the lower shell, and a bottom plate.

The said foam collecting device includes a foam collecting tank, a foam storage tank and at least one linking and supporting pipe between the two tanks.

The said feed distribution device includes a feed distribution tank and at least one feed pipe connecting with the column separator; the feed distribution tank is installed at the upper portion of the column separator.

Two kinds of fillers are used for the said packing media of the column separator, corrugated plate fillers used in the upper space above the feed pipe and tray plate fillers of at least one layer used in the lower space under the feed pipe. And on the tray plate fillers have at least two regions with different operture sizes and opening factors, which are disposed in the way of alternating arrangement.

The floatation apparatus further comprises a cyclonic separation device provided on the bottom plate. The said cyclonic separation device includes a cylindrical cyclonic shell and a horn-like section fixed on the upper of the cyclonic shell. The inside of the horn-like section forms a passage connecting the cyclonic separation device with the column separator, and the circular section between its outside and the inner wall of the lower shell forms an entrance of a discharge passage M-2.

A hole is provided at the center of the bottom plate, and a cyclonic reverse cone is installed on the bottom plate to divide the said hole into two discharge passages, a lower density material discharge passage M-1 and a higher density material discharge passage T. On the inner wall of the cyclonic shell at least one spiral leading plate is provided.

On the outside of the lower shell a jet pipe floatation device is provided, which includes a circulating pulp distribution tank, at least one auto-suction micro-bubble generator and at least one mineralization pipe segment connected with the said generator. The circulating pulp distribution tank is installed at the upper-middle portion of the outside of the lower shell. The upper ends of the auto-suction micro-bubble generator and the mineralization pipe segment are connected with the circulating pulp distribution tank, and the lower ends are horizontally passed through the lower shell and tangentially connected with the cylindrical cyclonic shell. An air pipe of the auto-suction micro-bubble generator is connected with a leading pipe lengthened to the upper end of the column separator, forming the air suction passage G.

Two discharge passages M-1 and M-2 are connected with the circulating pulp distribution tank of the jet pipe floatation device, and the outlet of the jet pipe floatation device is tangentially connected with the cyclonic separation device, forming the circulating passage of middlings' pipe floatation.

The said upper shell is usually occupied by the cleaning zone of the column separation, whose section area is greater than that of the said lower shell, the upper and lower shells are connected with the horn-like linking section.

The said tray plate filler may be a flat perforated plate, or a combination of a flat perforated plate and a supporting perforated plate. The flat perforated plate has at least two regions with different operture sizes and opening factors, which are disposed in the way of alternating arrangement. The supporting perforated plate is fixed under the flat perforated plate in radial direction along the border between two regions with different operture sizes, whose highness is corresponding to the support distance.

In the said column separator the tray plate fillers are packed in such way that the regions with same operture sizes and opening factors of different fillers are disposed in an alternating arrangement without strict requirement for the number of tray plate fillers in a unit of the vertical section, to obtain a zigzag pattern of fluid flowing within the packing zones.

The said discharge passage M-2 includes at least one inner leading pipe, at least one vertical spacing plate and one horizontal annular distribution plate. The spacing plate divides the space under the horizontal annular distribution plate into at least two parts, forming at least two annular discharge passages through the holes on the horizontal annular distribution plate, and the inner leading pipe(s) collects the pulp discharged from all annular discharge passages and transit it into a outer discharge pipe forming a whole discharge passage for the middlings.

Diameter ratio of the upper end opening of the said cyclonic reverse cone to the cyclonic shell is within the range of 0.5 to 0.9, and the lower section of the cyclonic shell is divided by the upper end opening of the said cyclonic reverse cone into two pulp passages. M-1 passage is formed by the inner side of the cyclonic reverse cone, the inner part of the hole of the bottom plate and a supporting and leading pipe connected with them. And T passage is formed by the annular seam of the outside of the cyclonic reverse cone, the outer part of the hole of the bottom plate, and a collecting discharge tank connected with them.

On the inside wall of the said cyclonic shell at least one spiral leading plate is provided, forming a passage downwards along the said wall for the pulp with high density The said auto-suction micro-bubble generator includes an upper jacket and a lower jacket fixed together by bolts. The upper jacket is stair-like, within a nozzle with at least one opening is provided and fixed by bolts. On its stair-like periphery air pipes are disposed. The lower jacket is a straight pipe, within which an end cap of a throat pipe, a throat pipe and a diffusion pipe are nested in order. The openings of the end cap of the throat pipe, and throat pipe and the diffusion pipe are reverse cone-like, cylindrical and horn-like respectively. The number of the opening at the end cap of the throat pipe, the throat pipe, the diffusion pipe and the nozzle is the same, at least one, forming at least one jet air-suction unit space arranged along the axis direction. The mineralization pipe segment is connected with the outlet of the auto-suction micro-bubble generator, whose length is no less than 1.5 m.

The sectional shape of the said foam collecting tank is ship-like, its upper opening forms inner and outer foam overflow weirs within the upper shell and its bottom is connected with a linking and supporting pipe to discharge the foam product.

2. The present invention also provides a cyclonic-static micro-bubble floatation apparatus, which comprises:

a column separator; and a foam collecting device and a feed distribution device both installed at the upper portion of the column separator.

The said column separator includes a column and packing media within it; the column comprises an upper shell, a lower shell, a horn-like linking section connected with the upper shell and the lower shell, and a bottom plate. The said foam collecting device includes a foam collecting tank, a foam storage tank and at least one linking and supporting pipe between the two tanks. The said feed distribution device includes a feed distribution tank and at least one auto-suction micro-bubble generator and at least one mineralization pipe segment connected with the above generator to form the feed pipe floatation device. The upper portion of the feed pipe floatation device is connected with the feed distribution tank, which is disposed along the length direction of the said feed distribution tank, an air pipe of the auto-suction micro-bubble generator is connected with a leading pipe lengthened to the upper end of the column separator, forming the air suction passage G-1.

Two kinds of fillers are used for the said column separator packing media, corrugated plate fillers used in the upper space above the feed pipe and tray plate fillers of at least one layer used in the lower space under the feed pipe. And in the tray plate fillers have at least two regions with different operture sizes and opening factors, which are disposed in the way of alternating arrangement.

The floatation apparatus further comprises a cyclonic separation device provided on the bottom plate. The said cyclonic separation device includes a cylindrical cyclonic shell, a horn-like section connected with the cyclonic shell and the lower shell, and a cyclonic reverse cone. The said cyclonic reverse cone is located at the central of the bottom plate, connected with the supporting and leading pipe to form a discharge passage M for the low density material. Around the cyclonic separation device at least one outer cyclonic separator is provided, its overflow opening is tangentially connected with the cyclonic shell and is functioned as a feed passage, and the collection and discharge passage T for the high density material is formed by the outside of the cyclonic reverse cone and the collecting discharge tank. On the inner wall of the cyclonic shell at least one spiral leading plate is fixed.

On the outside of the lower shell a jet pipe floatation device is provided, which includes a circulating pulp distribution tank, at least one auto-suction micro-bubble generator and at least one mineralization pipe segment connected with the said generator. The circulating pulp distribution tank is installed at the upper-middle portion of the outside of the lower shell. The upper ends of the auto-suction micro-bubble generator and the mineralization pipe segment are connected with the circulating pulp distribution tank, and the lower ends are horizontally passed through the lower shell and tangentially connected with the cyclonic shell. An air pipe of the auto-suction micro-bubble generator is connected with a leading pipe lengthened to the upper end of the column separator, forming the air suction passage G-2. The discharge passages M is connected with the circulating pulp distribution tank of the jet pipe floatation device and the outlet of the jet pipe floatation device is tangentially connected with the cyclonic separation device, forming the circulating passage of middlings' pipe floatation.

The structure of the upper and lower shells and their connecting relationship, the structure of the column packing media and their location, the installation of the spiral leading plates, the structure of the auto-suction micro-bubble generators and mineralization pipe segments and their connecting relationship, and the structure and linking relationship of the foam collecting tank are all the same as that in the embodiment 1.

The shape of the outer cyclonic separator is cylindrical, and inside its underflow opening an inner cyclonic reverse cone is provided to form an annular discharge passage for the underflow.

3. The present invention further provides a cyclonic-static micro-bubble floatation apparatus, which comprises:

a column separator; and a foam collecting device and a feed distribution device both installed at the upper portion of the column separator.

The said column separator includes a column and packing media within it; the column comprises an upper shell, a lower shell, a horn-like linking section connecting with the upper shell and the lower shell, and a bottom plate.

The said foam collecting device includes a foam collecting tank, a foam storage tank and at least one linking and supporting pipe between the two tanks.

The said feed distribution device includes a feed distribution tank and at least one auto-suction micro-bubble generator and at least one mineralization pipe segment connected with the above generator to form the feed pipe floatation device. The upper portion of the feed pipe floatation device is connected with the feed distribution tank, which is disposed along the length direction of the said feed distribution tank, an air pipe of the auto-suction micro-bubble generator is connected with a leading pipe lengthened to the upper end of the column separator, forming the air suction passage G-1.

Two kinds of fillers are used for the said column separator packing media, corrugated plate fillers used in the upper space above the feed pipe and tray plate fillers with at least one layer used in the lower space under the feed pipe. And the tray plate fillers have at least two regions with different operture sizes and opening factors, which are disposed in the way of alternating arrangement.

A group of cyclonic separation device is provided at the bottom plate, which includes at least one cyclonic separation unit, and every cyclonic separation unit includes one cyclonic separation device and at least one outer cyclonic separator arranged around the cyclonic separation device. The cyclonic separation device comprises a cylindrical cyclonic shell; a horn-like section connecting with the cyclonic shell and the lower shell or a unit spacing plate, and a cyclonic reverse cone connected. The cyclonic reverse cone is connected with the supporting and leading pipe via a circular hole in the bottom plate to form a discharge passage M for the material of low density. The overflow opening of the outer cyclonic separator is tangentially connected with the cyclonic shell to form the feed entrance for the cyclonic separation device. And the collection and discharge passage T for the underflow pulp of high density is formed by a discharge reverse cone, the cyclonic reverse cone, a annular hole around the said hole in the bottom plate and the collecting discharge tank. On the inner wall of the cyclonic shell at least one spiral leading plate is fixed. Corresponding to each cyclonic separation unit, the said unit spacing plate is installed at the upper end of two neighbors horn-like sections.

On the outer side of the lower shell a jet pipe floatation device is provided, which includes a circulating pulp distribution tank, at least one auto-suction micro-bubble generator and at least one mineralization pipe segment connected with the said generator. The circulating pulp distribution tank is installed at the upper-middle portion of the outside of the lower shell. The upper ends of the auto-suction micro-bubble generator and the mineralization pipe segment are connected with the circulating pulp distribution tank, and the lower ends are horizontally passed through the lower shell and tangentially connected with the cyclonic shell. An air pipe of the auto-suction micro-bubble generator is connected with a leading pipe lengthened to the upper end of the column separator, forming the air suction passage G-2. The discharge passages M of all cyclonic separation units join to form the middlings discharge passage which is connected with the circulating pulp distribution tank of the jet pipe floatation device, and the outlet of the jet pipe floatation device is tangentially connected with the outer cyclonic separator, forming the circulating passage of middlings' pipe floatation.

The structure of the upper and lower shells and their connecting relationship, the structure of the column packing media and their location, the installation of the spiral leading plates, the structure of the auto-section micro-bubble generators and mineralization pipe segments and their connecting relationship, and the structure and connecting relationship of the foam collecting tank are all the same as that in the embodiment 1.

The structure and the connecting relationship of the outer cyclonic separator are the same as that in embodiment 2.

At the upper ends of two neighbor horn-like sections a unit spacing plate is provided, whose upper level should not exceed that of the lower level of the mineralization pipe segment of the feed distribution device.

The present invention further provides a cyclonic-state micro-bubble floatation method, comprising the following procedures:

grinding pulp; mixing pulp;

leading the mixture obtained from the last step into the said feed distribution device of the above said apparatus;

distributing the mixture directly into or going through the feed pipe floatation device for primary separation and then into the column separator;

passing the pulp through layers of the tray plate fillers in the column separator with zigzag flowing pattern, meanwhile the pulp colloid with the lifting bubbles from the bottom of the column separator for mineralization, and then the mineralized bubbles including that formed inside the pipe floatation device pass the corrugated plate fillers and cumulate on the upper portion of the column separator to form a foam layer, which overflows into the foam collecting tank and then the concentrate product is discharged;

passing the pulp separated from the column separator into the cyclonic separation device, where three product pulps are separated according to their density;

transferring the middlings separated by the cyclonic separation device and a part of the pulp from the column separator into the circulating pulp distribution tank after pressurization, in the jet pipe floatation device the middlings is mixed with air suctioned, the air is crashed into micro-bubbles, and micro-bubbles are mineralized in intense turbulent conditions;

transferring the resultant from the last step to the cyclonic separation device for further cyclonic separation.

Thereby, a circular processing of the middlings is formed, that is, from the cyclonic separation to the jet pipe floatation and then back to the cyclonic separation. While the middlings is undergoing the circular separation, the overflow of the cyclonic separation enters the column separator and undergoes the mineralization of the column floatation and the underflow of the cyclonic separation is discharged as the end tailings.

The present invention also provides a cyclonic-static micro-bubble floatation method, which comprises more than one column separation unit connected in series or parallel, the said column separation unit consists of the above-mentioned floatation processing of the present invention.

The present invention has following unique features, which bring about many advantages over the prior art techniques:

1) Adopting an improved separation mechanism with combination of the cyclonic separation and the pipe floatation. The key step of this separation mechanism is to treat the middlings from the cyclonic separation process with the pipe floatation in condition of intense turbulent mineralization, and the treatment is performed in the way of multi-separation with pulp circulation out of the column, the tailings of this processing is discharged at last by the cyclonic separator, which can ensure the least loss of useful materials in the tailings. The separation in this process is not only based on minerals' differences of density and surface properties as well as taking full advantages of the two separation methods, but also intensified by multiple circulating and separating. Therefore, the apparatus of the present invention has higher separation efficiency, especially, for the feed with poor floatability. With this new procedure, this apparatus and the method of processing can be distinguished from any other type of floatation apparatus. The advantages from adopting this separation mechanism include: (1) decreasing the column highness; (2) increasing separation efficiency; (3) enhancing production capacity of the apparatus; (4) diminishing electrical consumption of the floatation operation.

2) Adopting a new separation processing for fine particles with a perfect performance by combination of the column separation and mechanism of separation intensification. This technique keeps the merit of the floatation column, that is, the high floatation selectivity, and increases separation efficiency and recovery by intensifying mineral separation as well.

3) Applying mixture packing of the column with both fillers of corrugated plate and tray plate. Packing with the corrugated plate is beneficial to forming a stable foam zone and to diminishing mechanical entrainment. And packing with the tray plate is beneficial to increasing the production capacity and floatation selectivity of the column and eliminating the possible clogging or plugging caused by the corrugated plate.

4) Adopting a auto-suction micro-bubble generator with excellent aeration performance and a simple structure, in which air is crashed and a lot of micro-bubbles is formed, and the energy consumption is low. Because of installing a mineralization pipe segment of a certain length next to the generator, a condition of intense turbulence for mineralization is established, and a pipe floatation is realized.

5) Installing a feed pipe floatation device next to the feed pipe of the column separator to selectively float the component with better floatability and increase the separation efficiency.

6) Collecting the foam product with a two-weir built-in foam collecting tank, which approximately doubles size of the overflow periphery, and is beneficial to discharging the foam product in time and to diminishing the foam dead zone and avoiding collapse of the established foam layer.

7) Adopting modulator combination technique of cyclonic separation units and column separation units to meet different requirements of the production capacity. This technique involves in the variation of structure of cyclonic separation units (from single cyclone to double cyclone), the combination of the cyclonic separation unit and the column separation unit. Both of them may be applied as means for increasing the separation efficiency of this processing and makes the expansion of its production capacity more convenient. This technique can not only ensure the separation performance and increase separation efficiency for the feed with fine product, but also lower the investment and operation cost and simplify the management of the production for the feed with low grade of floatability.

The cyclonic state micro-bubble floatation apparatus may be seriated and applied to both anthracitic and bituminous coals. And a clean coal product with ash and sulfur contents less than 2.0% and 0.2%, respectively, has been obtained by this apparatus in industrial scale. It can been used for coal recovery from slime with a high ash content (as high as 50%), and the quality of its concentrate can match that of the conventional floatation. Compared with the conventional floatation machines, the ash content of the concentrate product by this apparatus decrease by about one to two percentage, and all size particles of fine coal can been recovered satisfactorily. This apparatus can operate without any kind of air compressors and decrease the energy consumption by ⅓~½, compared with the conventional floatation columns.

DESCRIPTION OF THE PREFERRED EMBODIMENTS

The present invention will be described in more detail referring to the above drawings. It should be pointed out that the present invention also be implemented in many other ways, different from the following described embodiments. The embodiments are provided for disclosing the content of the invention to the public completely and accurately.

EMBODIMENT 1

Figure 3:
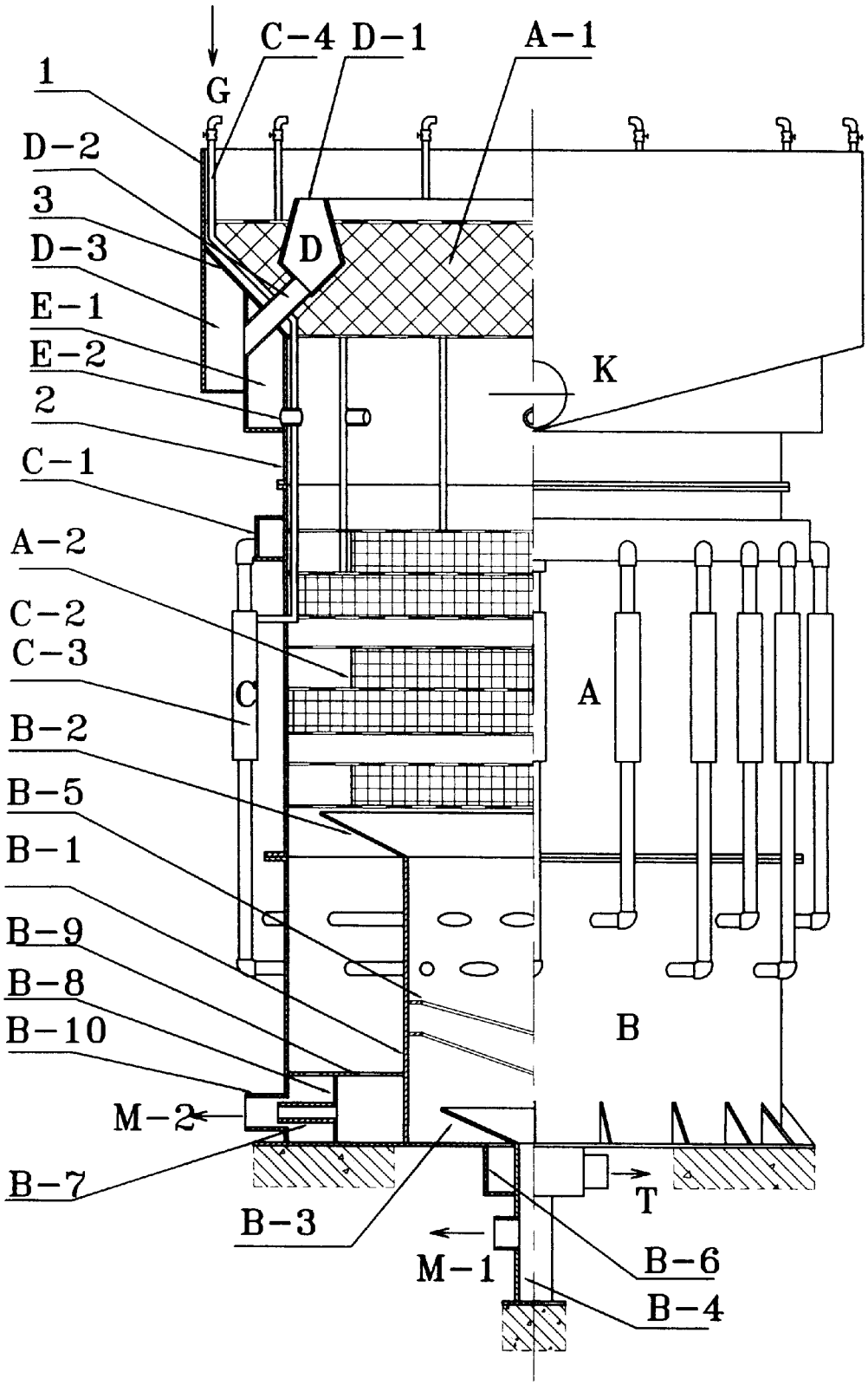
FIG. 3 is a schematic view of apparatus structure of embodiment 1 of the present invention.

As shown in FIG. 3 a single-cyclonic static micro-bubble floatation column includes a column separator A, a feed distribution device E and a foam collecting device D both fixed at the upper portion of the column separator A, and a cyclonic separation device B and a jet pipe floatation device C. The column separator A and the cyclonic separation device B are connected with each other vertically. The passage of the middlings separated by the cyclonic separation device B is connected with the jet pipe floatation device C, and the outlet of the jet pipe floatation device C is tangentially connected to the cyclonic separation device B to form a circulating passage for the middlings. The underflow passage of the cyclonic separation device B is the passage for the end tailings, and the foam discharge passage of the foam collecting device D is the passage for the end concentrate product.

The said column separator A comprises the column and two kinds of packing media in the column. The shape of the column is cylindrical, which includes a upper shell 1 and a lower shell 2, a horn-like linking section 3 connected with the upper shell and the lower shell, and a bottom plate 4. The upper shell 1 is occupied by the cleaning zone of the column separator A, and its section area should be greater than that of the lower shell 2 to form beneficial conditions for foam separation and to improve the effect of "secondary cumulating". The space above the feed pipe E-2 is packed with the corrugated plate fillers A-1, and that under the feed pipe E-2 packed with at least one layer of the tray plate filler A-2.

Figure 4:
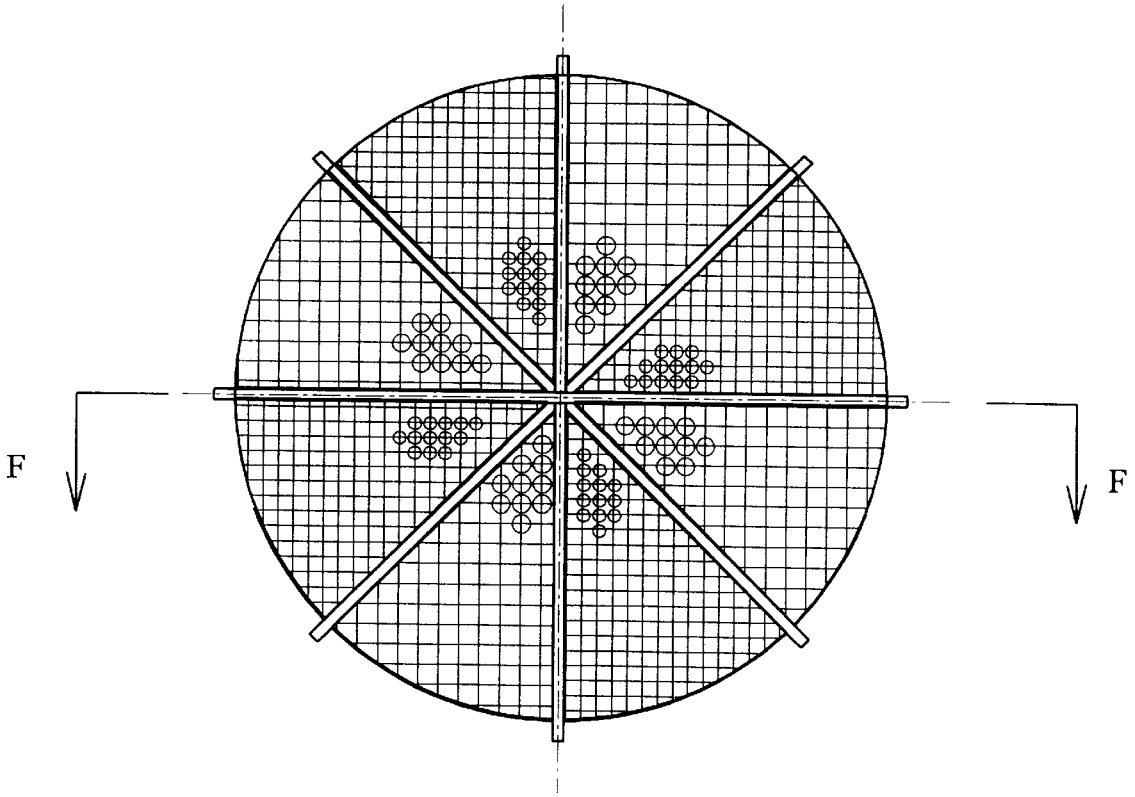
FIG. 4 is a schematic view of structure of the tray plate filler of the present invention.
Figure 5:
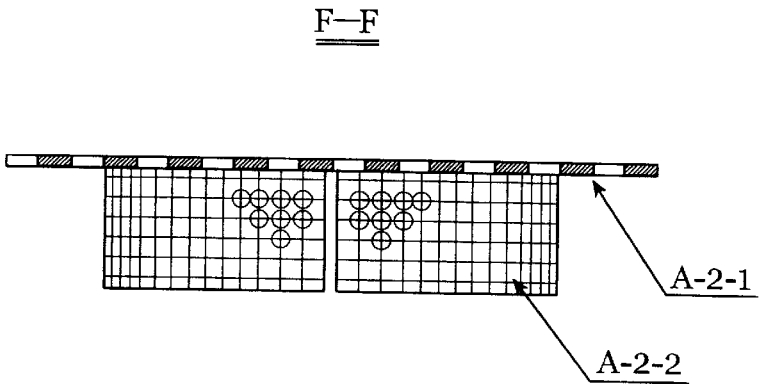
FIG. 5 is a cross sectional views along the line H—H of the FIG. 4.

As shown in FIGS. 4 and 5, the tray plate filler may be a flat perforated plates A-2-1 or a combination of the flat perforated plates A-2-1 and a supporting perforated plates A-2-2. The size of the flat plate filler A-2 is a little less than that of the sectional area of the lower shell 2, and on it at least two regions with different operture sizes and opening factors are alternatively arranged. There is not any strict requirement for the length of the supporting perforated plate A-2-2 but its highness must correspond to the supporting highness. Generally, the supporting perforated plate A-2-2 is fixed in radial pattern at the borders of zones with different operture sizes and opening factors of the flat perforated plate A-2-1. The sizes of the opertures is within the range of 5 to 20 mm, and the opening factors are within the range of 25% to 50%. All tray plate filler A-2 are packed in such way that the regions with same operture sizes and opening factors of different tray plate fillers A-2 are disposed in alternating way, and the number of tray plate filter A-2 in a unit highness and their relative location need not strictly be limited but the whole arrangement of the packing section should make the pulp flowing within the space of the column separator in a zigzag pattern.

Generally, a part of the flat perforated plate A-2-1 is directly fixed on the inner wall of the lower shell 1 in a certain distance forming an integrated tray and the tray plate filler A-2 with the supporting perforated plates A-2-2 is placed directly on the fixed tray plate as a whole. The packing technique with the corrugated plate fillers A-1 is known in the filed, and a modular integrated filler of the corrugated fillers A-1 may be directly placed on the prefixed flat perforated plate.

Many kinds of materials can be used for building the filler media, for example, stainless steel plate, common steel plate and PVC and so on. However, the corrugated plate fillers A-1 are usually made of the stainless steel and the tray plate fillers A-2 prefer the common steel.

Combination of the corrugated plate fillers A-1 and the tray plate fillers A-2 is beneficial to the separation process. Application of the corrugated plate fillers A-1 can form a stable foam layer and avoid the mechanical entrainment and intermixing of different mineral components. And application of the tray plate fillers A-2 can form good conditions for static mineralization and separation to increase the recovery capacity and the separation selectively, at the same time, to decrease the opportunity of plugging caused by using of the corrugated plate fillers A-1.

Distinguished from to traditional packing with the common tray fillers, in the present invention the tray plate fillers A-2 are packed in such way that the regions with same opening factors and operture sizes of different fillers are disposed in alternative way, resulting in an improving effect of so called "resistance variation". The purpose of this pattern of arrangement is to have the pulp flowing in a zigzag pattern within the column separator A and to extend the pulp passage length and residential time to increase the efficiency of reverse collision and mineralization of air bubbles. Besides, the alternative variation of the resistance produced when the mineralized bubbles are lifting may result in their distortion, disruptive and combination, which may function as an additional refining separation.

The said feed distribution device E includes a feed distribution tank E-1, which connects the column separator A with at least one feed pipe E-2. The tank is located at the outside of the upper portion of the lower shell 2 and made up of steel plate welded around the lower shell 2. The feed passage F is formed by an opening on outside wall of the feed distribution tank E-1 in the feeding direction.

The said cyclonic separation device B is located on the bottom plate 4, it comprises a cylindrical cyclonic shell B-1, a horn-link section B-2 fixed on the B-1, and the bottom plate 4 of the column separator A serving as the bottom plate 4 of the cyclonic separation device B as well. The highness and diameter of the upper portion of the horn-like section B-2 can vary with the different specifications of the apparatus if the pulp can flow smoothly and fluently in its narrow annular seam and the solid particles will not settle on its upper surface, the highness of cyclonic shell B-1 is within the range of 0.7 to 1.5 m, and the diameter of the cyclone shell B-1 is determined by the required production capacity, for example, the diameter of the cyclonic shell B-1 of ϕ3.0 m floatation column is 2.0 m.

At the center of the bottom plate 4 there has a hole, and a cyclonic reverse cone B-3 is installed on the bottom plate 4, dividing the central hole of the bottom plate 4 into inner and outer passages, the inner passage is connected with the supporting and leading pipe B-4 to form a discharge passage M-1. The taper of the cyclonic reverse cone B-3 is about 60–150° C., the ratio of the maximum diameter at the upper section of the cyclonic reverse cone B-3 to that of the cyclonic shell B-1 is about 0.5–0.9, the inner diameter of its lowest section of the cyclonic reverse cone B-3 is determined according to the required production capacity of the apparatus, consistently to the size of the supporting and leading pipe B-4. For example, the diameter of the inner passage of the floatation column with 1.5 m diameter is 100 mm, and that of the central hole 250–300 mm.

In the second of the cyclonic shell B-1 between the cyclonic reverse cone B-3 and the opening of feed there is at least one spiral leading B-5 installed to form a passage for the material with high density downward along the inner side of the cyclonic shell B-1. The discharge passage T of the material with high density consists of the outer side of the cyclonic reverse cone B-3, outer passage of the central hole at the bottom plate 4, and a collecting discharge tank B-6 installed under the bottom plate 4.

A discharge passage M-2 for floatation middlings is also located between the lower shell 2 and the cyclonic shell B-1, including at least one inner leading pipe B-7, at least one vertical spacing plate B-8 and one horizontal annular distribution plate B-9. The vertical spacing plate B-8 should divide the space under the annular distribution plate B-9 into at least two parts and form at least two circular discharge passages through the hole of the distribution plate B-9. The inner leading pipe B-7 transits the pulp from all discharge passages into the discharge pipe B-10 which functions as the middlings discharge opening.

The cyclonic separation device B divides the pulp after a column floatation into two parts according to the difference of their density and delivers them into the two passages of M-1 and T, the natures of materials in the two passages depend on the feed material. If the material processed is coal, the pulp in the passage M-1 is treated as circulating middlings, and that in passages T treated as tailings. And if the material processed is mineral, the method is contrary. However, the pulp in the passage M-2 can be treated always as the circulating middlings due to lack of a cyclonic separation, in practice its flow rate is usually controlled by a valve installed at its outer pipe.

There is not any specific requirement of their building materials for all above-mentioned parts, except that the surface of all parts in the pulp passages susceptible to wear out, such as the cyclonic shell B-1 which should be covered on its inner wall with some abrasion-resistant materials.

The said jet pipe floatation device C comprises a circulating pulp distribution tank C-1, at least one auto-suction micro-bubble generator C-2, and at least one mineralization pipe segment C-3 used as a pipe floatation device to mineralize air bubbles. The circulating pulp distribution tank C-1 is fixed on the outside of the upper-middle of the lower shell 2, installed with common steel plate around the lower shell 2 with requirement of a pressure resistance of 0.6 MPa or more. The auto-suction micro-bubble generator C-2 and mineralization pipe segment C-3 are connected with the distribution tank C-1 at the upper end, and connected tangentially with the cyclonic shell B-1 at the lower end after it pass through the lower shell 2 horizontally. An air pipe of the auto-suction micro-bubble generator C-2 is connected with leading pipe C-4 lengthened to the upper end of the column separator A, forming air suction passage G.

Figure 6:
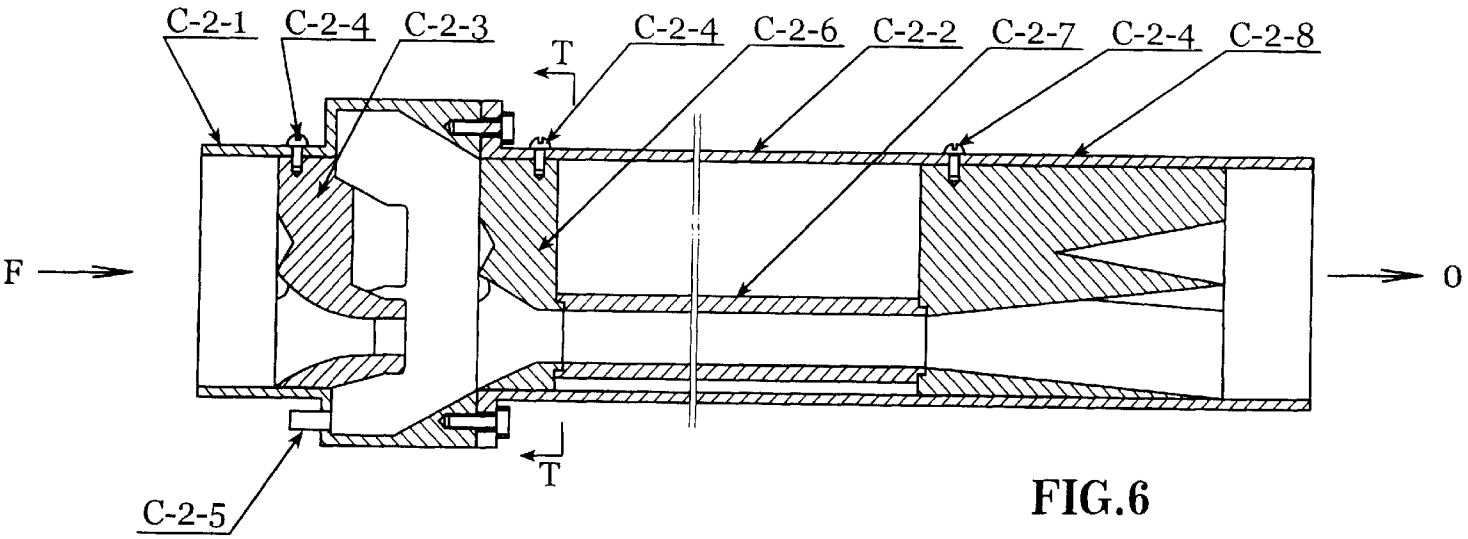
FIG. 6 is a schematic view of structure of the auto-suction micro-bubble generator of the present invention.
Figure 7:
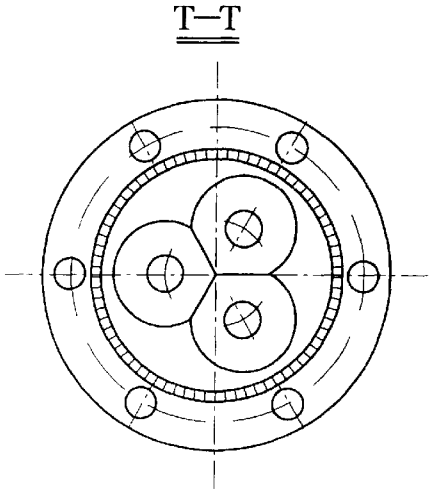
FIG. 7 is a cross sectional views along the line T—T of the FIG. 6.

As shown in FIGS. 6 and 7, the auto-suction micro-bubble generator C-2 made up of a upper jacket C-2-1 and a lower jacket C-2-2 connected by bolts. The shape of the upper jacket C-2-1 is like a staircase, within which there is a nozzle C-2-3, installed with bolts C-2-4, and around the stair there are several air pipes C-2-5 distributed evenly. The lower jacket C-2-2 is a straight pipe, in which an end cap of a throat pipe C-2-6, a throat pipe C-2-7, and a diffusion pipe C-2-8 are installed in succession. The opening shape of the end cap C-2-6 is like an reverse cone and that of the throat pipes C-2-7 a cylinder, and that of the diffusion pipes a horn. The number of the holes in above three parts and the nozzle C-2-3 is the same, that is, at least one opening, which are symmetrically disposed around their axis to form at least one air suction unit spaces. After the circulating middlings with pressure (as the operating medium) enters the auto-suction micro-bubble generator C-2, at least one jet flow is produced with the nozzle C-2-3, forming about a space with negative pressure between the nozzle C-2-3 and the end cap of the throat pipe C-2-6, and then leading up to suction of a great amount of air through the air pipe C-2-5. The jet flow or flows with the suctioned air pass through the holes in the end cap of the throat pipe C-2-6, the throat piped C-2-7, and the diffusion pipe C-2-8, forming an intense turbulent conditions, and having the air divided into many micro-bubbles, then the circulating middlings and the micro-bubbles together enter into the mineralization pipe segment C-3. The diameter of the mineralization pipe segment C-3 is the same as that of the outlet of the micro-bubble generator C-2, and its length should be 1.5 m or more if it is possible when disposed within the available space. The greater the length of the mineralization pipe segment is, the higher the degree of air bubble mineralization. The surface of the parts in the pulp passages susceptible to wear out, such as the surfaces of the nozzle C-2-3, the throat pipe C-2-7, and the diffusion pipe C-2-8, should also be covered with some abrasion-resistant materials or made up of some abrasion-resistant materials, such as PVC and nylon and so on.

The said foam collecting device D comprise a foam collecting tank D-1, at least one linking and supporting pipes D-2, and a foam storage tank D-3. The foam collecting tank D-1 is like a ship in the vertically sectional view, the upper opening forms two foam overflow weirs within the column separator A. In general, the vertical location of the weirs is below the upper edge of the upper shell 1 by about 300–500 mm, and their horizontal location (which determines the size of the foam collecting tank D-1) is in a proper position so that the tank may equally divide the inner and outer foam layers. The benefit of this tank design may speed the foam product discharge and decrease the water content of the foam product as well.

The linking and supporting pipes D-2 are used to connect the lower portion of the foam collecting tank D-1 and the upper portion of the foam storage tank D-3, and to support the foam storage tank D-3. The diameter of the pipes D-2 can be selected as any amount if a smooth foam flow can be realized. The foam storage tank D-3 is a closed channel around the feed distribution tank E-1, linked at its upper end with the horn-like liking section 3, and its outer diameter is equal to that of the upper shell 1, and its bottom plate slopes forward at a certain angle to ensure the foam product self-moving, and its lowest end K is opened for discharge of the foam product. The function of the foam storage tank D-3 is to form a uniform discharge passage for the foam product.

The operation procedures of embodiment 1 is as the following:

The feed flows from the feed distribution tank E-1 through the feed pipe E-2 into the column separator A automatically or by a pressure difference; then the pulp moves downward through the tray plate filler A-2 and the whole column separator A to the horn-like section B-2, and undergoes the whole separation in the column separator A. When the pulp enters the cyclonic separation device B, it begins a vortex movement induced by the circulating middlings tangentially entering into the cyclonic separation device B and undergoes a cyclonic separation. The pulp at the bottom of cyclonic separation device B will be divided into two parts by the cyclonic reverse cone B-3 and discharged into two discharge passages, the pulp into the inner passage will be discharged and reused as the circulating middlings M-1 through the supporting and leading pipe B-4 and that into the outer passage will pass the outside of the cyclonic reverse cone B-3 and run through the collecting discharge tank B-6 to be discharged as tailings T.

When entering into the cyclonic separation device B, a split flow of the pulp processed by the column separator A is being transited by the horn-like section B-2 into an annular passage between the lower shell 2 and the cyclonic shell B-1, functioning as the middlings M-2. The middlings M-2 runs first through the annular distribution plate B-9 into the annular collecting space formed by the vertical spacing plates B-8, then it is discharged by the inner leading pipe B-7 and the outer discharge pipe B-10.

The quantities of the circulating middlings M-1 and M-2 can be regulated according to the production conditions. And both kinds of the middlings will be sent to the circulating pulp distribution tank C-1 and pressurized and, then, supplied evenly for every auto-suction micro-bubble generator C-2 and mineralization pipe segment C-3. In the auto-suction micro-bubble generators C-2 and the mineralization pipe segment C-3, the jet flow of intense turbulence plays a great role in fulfilling air suction from the leading pipe C-4, crashing air and forming micro-bubbles and mineralizing the created bubbles. The pulp, after pipe floatation, still has enough energy and enters tangentially into the cyclonic separation device B, forcing the fluid within the separation apparatus B to intensely rotate and respectively separating foam product, middlings and tailings in a circular way. This is the key for the whole separated process, and the bubbles (including mineralized bubbles created in all sub-processes) rise in the column separator A to its surface and forms the foam layer, and overflows through both two overflow weirs into foam collecting tank D-1, then enters the foam storage tank D-3 through the linking and supporting pipes D-2 and, at last, produces the concentrate K.

Embodiment 1 is suitable for production of a relatively smaller capacity and/or a requirement for relatively higher product quality. For instance, a product of the clean coal of ash content as low as 2.0% or less was obtained by this apparatus, and so does a concentration recovery rate of as high as 90% or more.

EMBODIMENT 2

Figure 8:
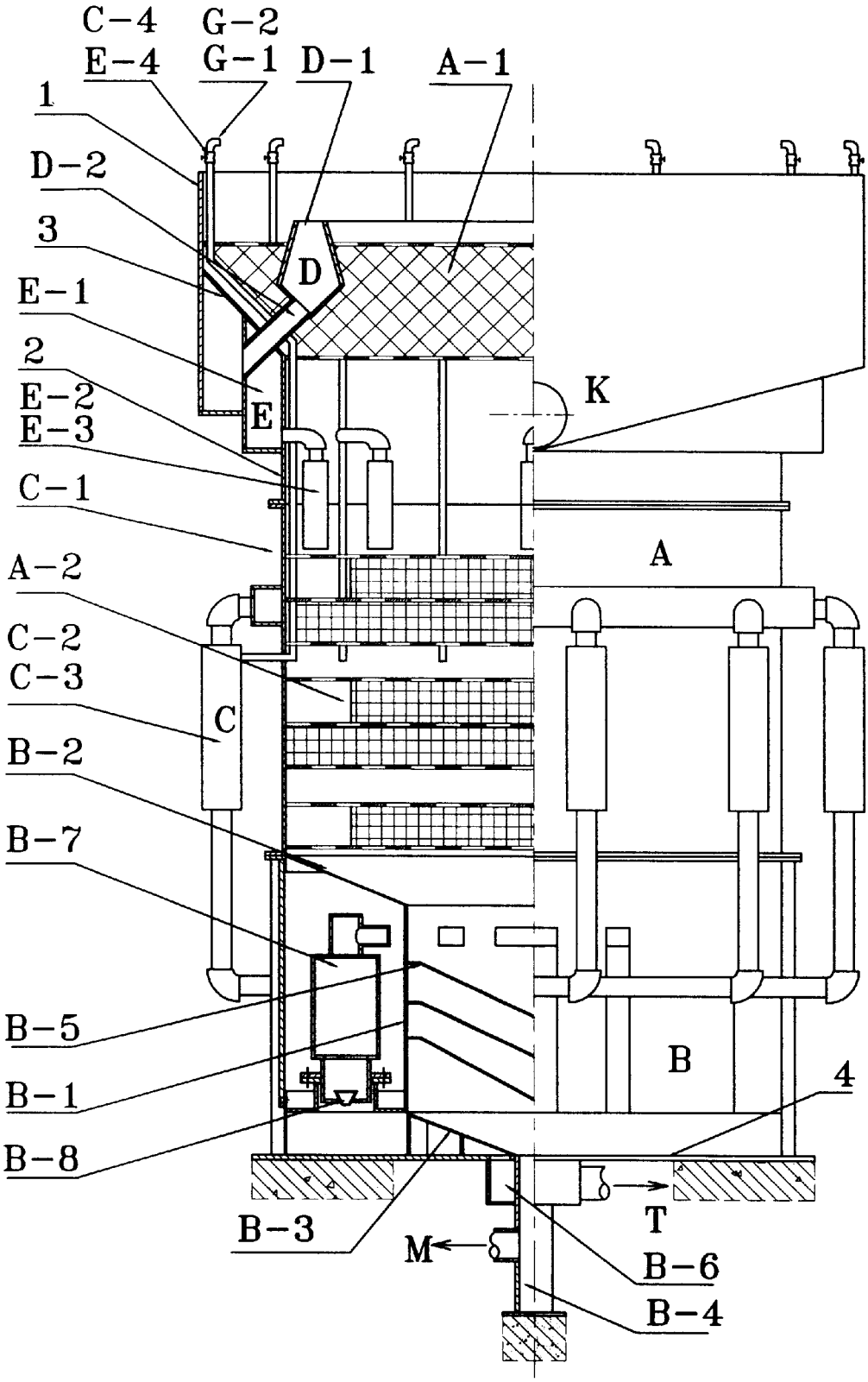
FIG. 8 is a schematic view of apparatus structure of embodiment 2 of the present invention.
Figure 9:
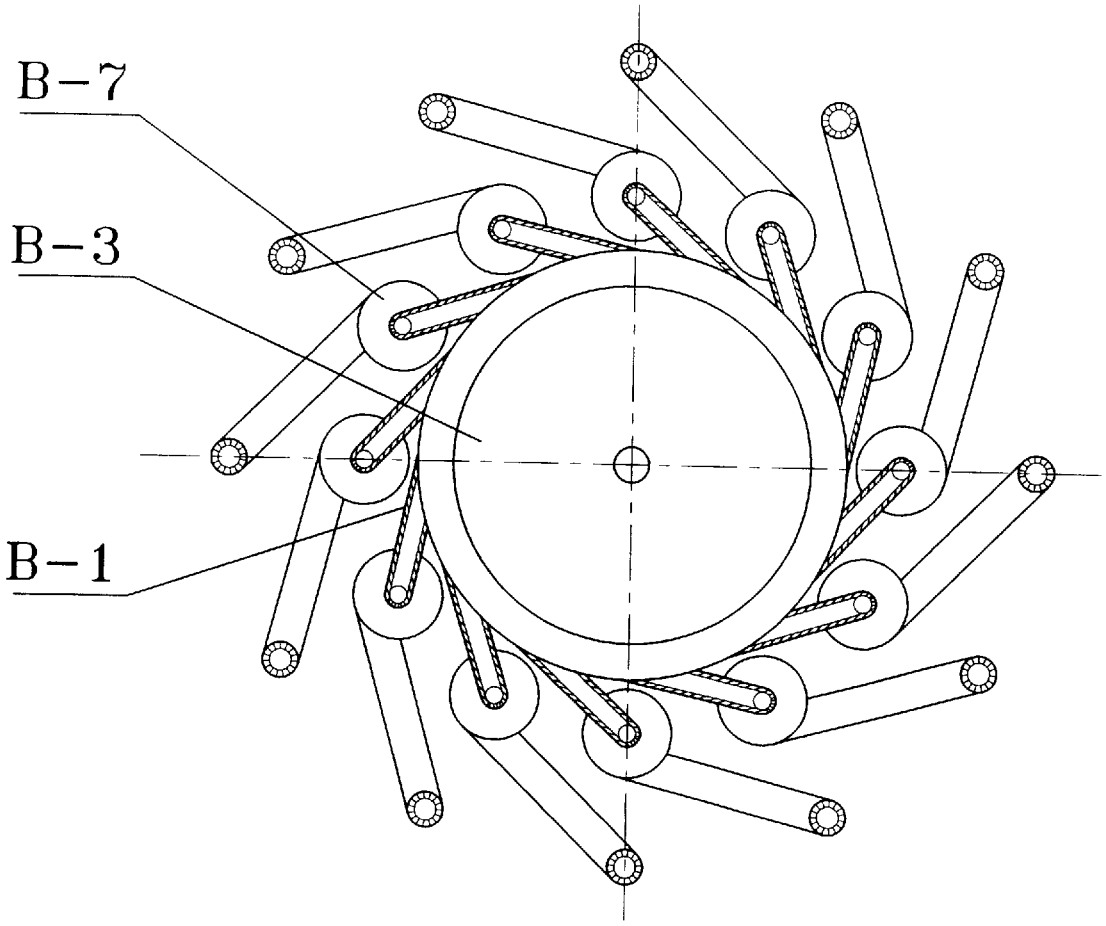
FIG. 9 is a part cross sectional views along the line V—V of the FIG. 8.

A double-cyclonic static micro-bubble floatation column, shown in FIGS. 8, 9, which comprises a column separator A, a feed distribution device E and a foam collecting device D both located at the upper section of the column separator A, and a cyclonic separation device B and a jet pipe floatation device C both installed at the lower section of the column separator A. The column separator A and the cyclonic separation device B are connected vertically. And the middlings passage from the cyclonic separation device B connects with the jet pipe floatation apparatus C, and the discharge opening of the jet pipe floatation apparatus C connects tangentially with the cyclonic separation device B, both of which build a circulating passage for the middlings of cyclonic separation. The tailings of this process is discharged by the bottom openings of the cyclonic separation device B, and the foam product is obtained through the passage at the foam collecting device D.

The feed distribution device E depicted thereafter includes a feed distribution tank E-1, and at least one feed pipe floatation device which consists of an auto-suction micro-bubble generator E-2 and a mineralization pipe segment E-3. The feed distribution tank E-1 has a uniform opening as the feed passage F, and the tank E-1 connects with the upper parts of the feed pipe floatation device which are disposed in the direction of its length, in this way the feed may be evenly distributed into the upper part of the column separator A. The air pipe C-2-5 of the auto-suction micro-bubble generator E-2 is connected with a leading pipe E-4 lengthened to the upper end of the column separator A, forming an air suction passage G-1.

The said column separator A is the same as that in the Embodiment 1.

The cyclonic separation device B depicted thereafter comprises a cylindrical cyclonic shell B-1, a horn-like section B-2 connecting the lower shell 2 with the cyclonic shell B-1, and a cyclonic reverse cone B-3 connected with the cyclonic shell B-1. The cyclonic separation device B is fixed on the bottom plate 4 and supported by the lower portion of the cyclonic shell B-1 and the cyclonic reverse cone B-3. At its lowest end, the cyclonic reverse cone B-3 passes through the central hole of the bottom plate 4 and connects with the supporting and leading pipe B-4 under the bottom plate 4 to form a discharge passage M of the product with low density.

On the inner side of the cyclonic shell B-1 there is at least one spiral leading plate B-5, to form a passage downward along the inner wall of the cyclonic shell B-1 for the material with high density.

As shown in FIG. 9, there is at least one outer cyclonic separator B-7 installed around the cyclonic separation device B, its overflow opening connects tangentially with the cyclonic shell B-1 to form the feeding passage of the cyclonic separation device B. The shape of the outer cyclonic separator B-7 is like a cylinder. And within the central of its bottom opening a inner cyclonic reverse cone B-8 is installed to form a annular discharge passage for the outer cyclonic separator B-7.

Below the cyclonic separator B-7 there is an underflow collecting space and discharge passage T for the product with high density, which is formed by the lower shell 2, the cyclonic reverse cone B-3 of the cyclonic separation device B, the bottom plate 4 and the collecting discharge tank B-6 fixed under the bottom plate 4. The passage of high density material must passes through all openings located at lower part of the cyclonic shell B-1 responding to every outer cyclonic separator B-7, and an annular hole around the supporting and leading pipe B-4 in the bottom plate 4.

The diameter of the outer cyclonic separator B-7 is smaller than that of the cyclonic separation device B, and at least one outer cyclonic separator B-7 and one cyclonic separation device B are combined to form a cyclonic separation unit. For coal preparation, at least one cyclonic separator B-7 of smaller size with more intense turbulent conditions is used to obtain the end tailings and one cyclonic separation device B of bigger size with less intense turbulent conditions is used to get the middlings for its further separation.

The said jet pipe floatation device C and foam collecting device D are the same as that in embodiment 1.

The operating procedures of embodiment 2 is as the following:

The feed flows into the feed distribution tank E-1 and is distributed into the feed pipe floatation device (mainly including the auto-suction micro-bubble generators E-2 and mineralization pipe segment E-3) to fulfill the pipe floatation. After that the pulp enters the column separator A, flowing through the tray plate filler A-2 and undergoing whole separation within the column separator A, and then being sent to the cyclonic separation device B.

In the cyclonic separation device B the pulp moves cyclonically induced by the circulating middlings which enters the cyclonic separation device B tangentially and undergoes a cyclonic separation, leading the pulp of high density material discharged as the circulating middlings through the spiral leading plate B-5, the cyclonic reverse cone B-3, and supporting and leading pipe B-4. The circulating middlings discharged will be pressurized and sent to a circulating pulp distribution tank C-1 for its distribution evenly into all auto-suction micro-bubble generators C-2 and mineralization pipe segment C-3. With the help of jet flow, the auto-suction micro-bubble generators C-2 and the mineralization pipe segment C-3 fulfill the air suction from the leading pipe C-4, crashing air and forming micro-bubbles and mineralizing the created bubbles. The pulp, after pipe floatation, still has enough energy and enters tangentially into the cyclonic separator B-2 and separating two pulp products.

The overflow of cyclonic separator B-7 enters tangentially into the cyclonic separation device B to be further cleaned, the underflow will be discharged as the end tailings through the outer discharge tank B-6. The bubbles, middlings and tailings are separated circularly by combination of the two separation methods. The bubbles and mineralized bubbles created in all sub-processes rise in the column separator A to its surface and forms the foam layer, and overflows through two overflow weirs into foam collecting tank D-1, then enters the foam storage tank D-3 through the linking and supporting pipe D-2 and, at last, discharged as the foam product.

Embodiment 2 presents a new cyclonic separation method, which may improve the capacity of separation and recovery of the process and solve the problems when to expand the production capacity of the apparatus. It is suitable for mineral processing for good floatability feeds and with middlings production capacity. For instance, a clean coal of ash content less than 8.0% or less and its recovery about 80% was obtained by this apparatus with diameter of 3.0 m, and the feed treatment capacity reaches 250 $m^3/h$.

EMBODIMENT 3

Figure 10:
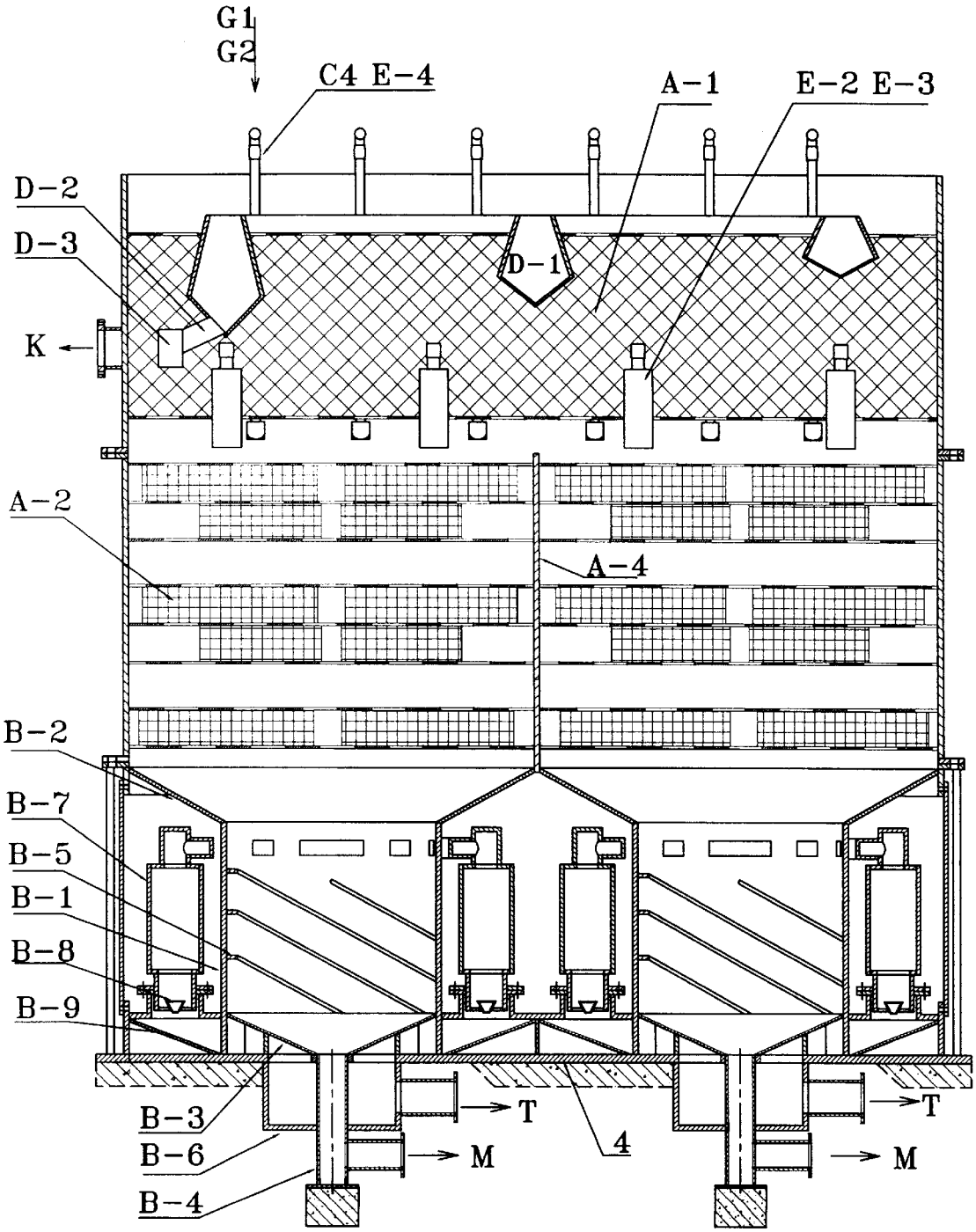
FIG. 10 is a schematic view of main structure of embodiment 3 of the present invention.
Figure 11:
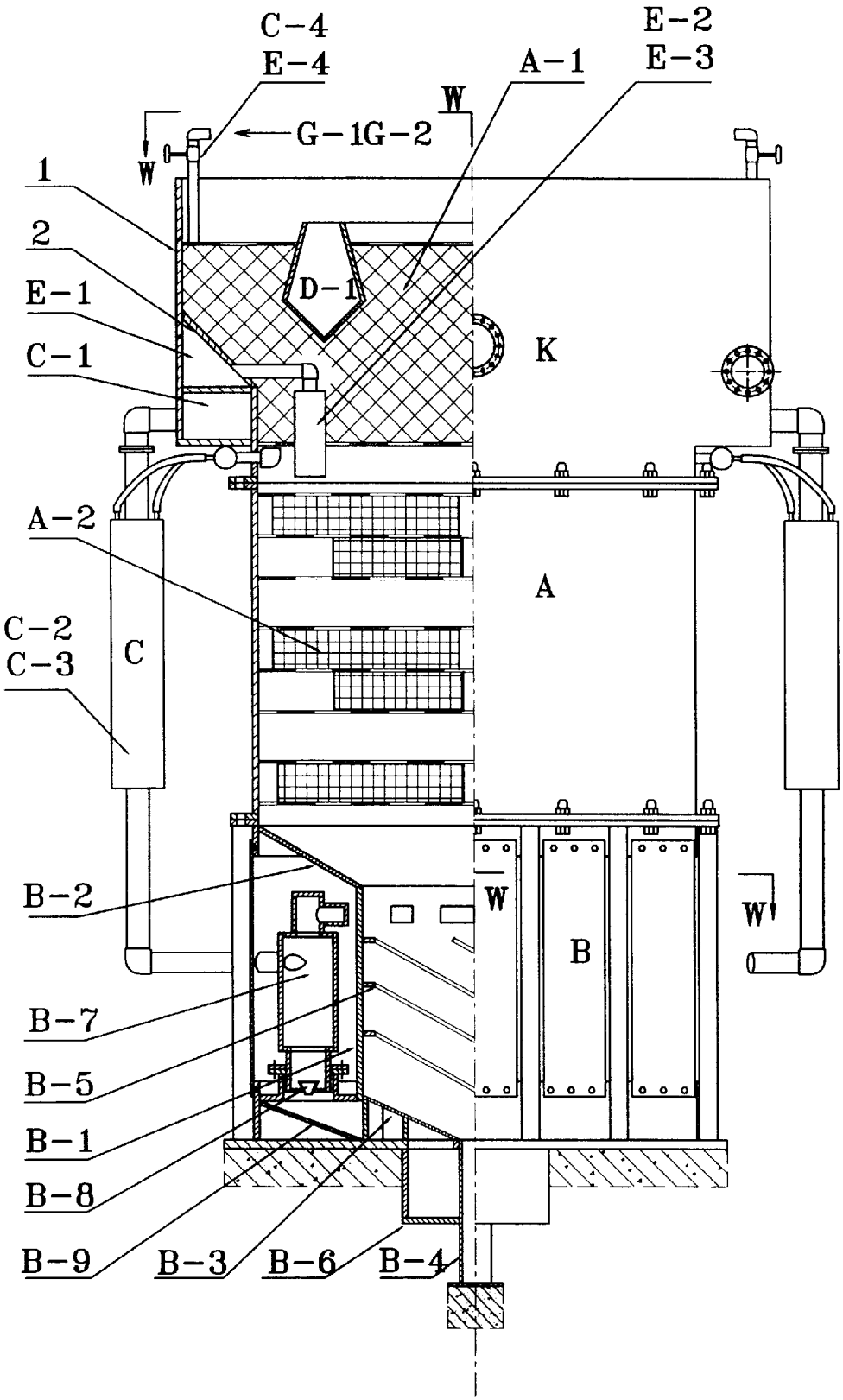
FIG. 11 is a schematic side view of apparatus structure of embodiment 3 of the present invention.
Figure 12:
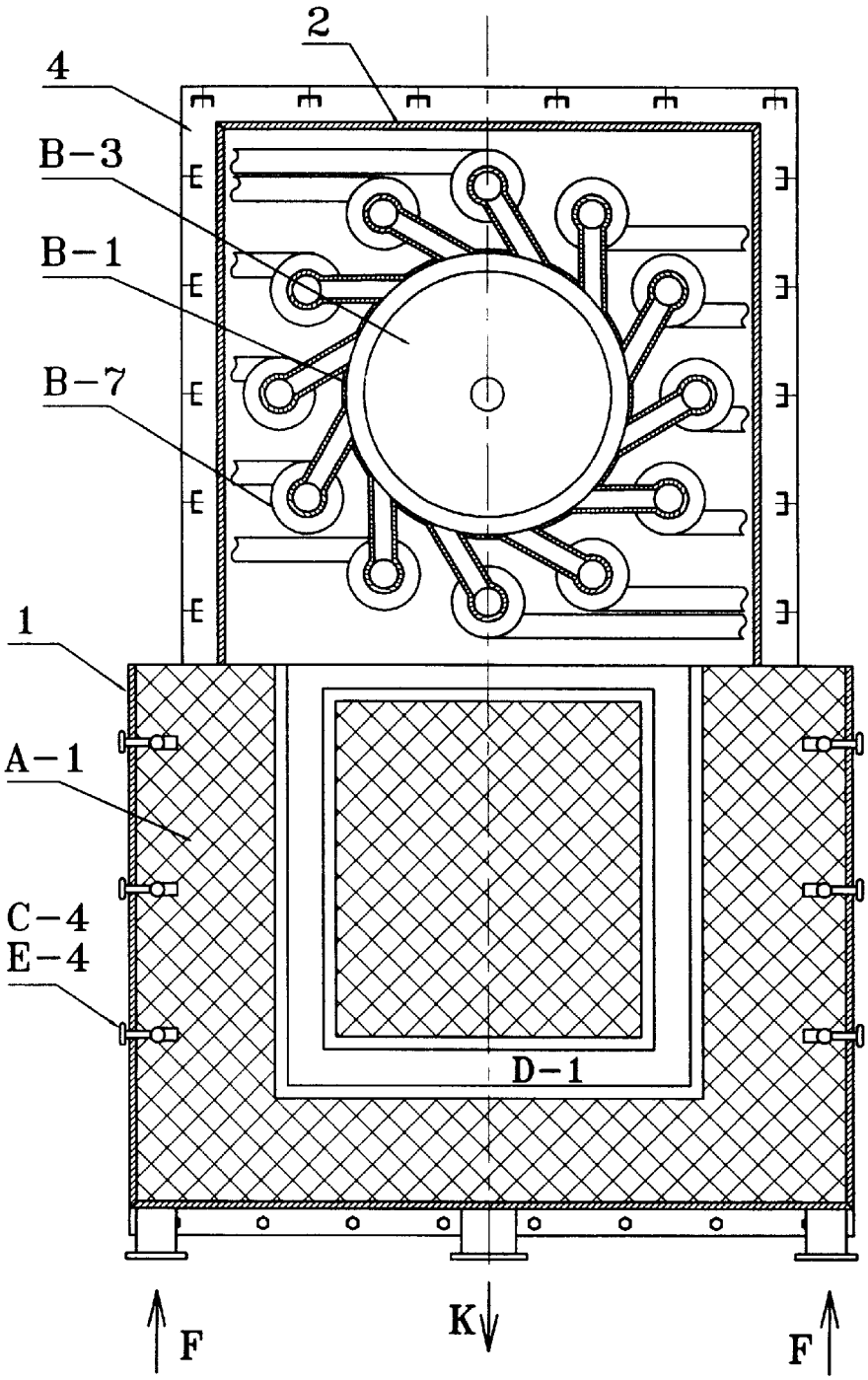
FIG. 12 is a part cross sectional views along the line W—W of the FIG. 11.

A cyclonic-static micro-bubble flotation bed is shown as in FIGS. 10, 11 and 12, which includes a column separator A, a feed distribution device E and a foam collecting device D both installed at the upper portion of the column separator A, and a group of cyclonic separation device B-G and a jet pipe floatation device C fixed at the lower portion of the column separator A. The column separator A and the group of cyclonic separation device B-G are connected vertically. And the passages of the group of the cyclonic separation device B-G for middlings pulp are connected with the jet pipe floatation device C, whose discharge opening is connected to the group of the cyclonic separation device B-G, which forms a circulating passage way for middlings separation. The end tailings comes from the underflow opening of the group of the cyclonic separation device B-G and the foam product from the foam collecting tank D-1. In fact, it is a combination of the column separation units like the single-cyclonic static micro-bubble floatation column or the double-cyclonic static micro-bubble floatation column.

The column separator A depicted here is the same as that in both Embodiment 1 and 2.

The feed distribution device E depicted thereafter includes a feed distribution tank E-1, at least one feed pipe floatation device made up of at least one auto-suction micro-bubble generators E-2 and at least one mineralization pipe segment E-3. The feed passage F is formed by the feed opening at the feed distribution tank E-1, the upper portion of the feed pipe floatation device is connected with the feed distribution tank E-1 and disposed in the length direction for its even distribution. The air pipe of the auto-suction micro-bubble generator E-2 is connected with the leading pipe E-4 lengthened to the upper end of the column separator A, forming an air suction passage G-1.

The group of the cyclonic separation device B-G includes at least one cyclonic separation unit introduced above. The difference between it and the apparatus with single cyclonic separation unit is the connecting method for the bottom discharge passages of the cyclonic separation device B, as shown in FIGS. 10 or 11. At the lower portion of the outer cyclonic separator B-7, its underflow collection and discharge passage T is created by the discharge reverse cone B-9 and the cyclonic reverse cone B-3, and the collecting discharge tank B-6 fixed under the bottom plate 4.

According to the number of the cyclonic separation units, the lower space of the column separator A is divided into the correspondent separation compartments with the unit spacing plates A-4. A compartment and a separation unit becomes a complete column separation unit, and two or more complete column separation units installed in series or parallel forms a complete floatation bed.

The jet pipe floatation device C depicted here is the same as that in Embodiment 1 and 2.

The foam collecting device D depicted here is the same as that in Embodiment 1 and 2.

The operation procedures of embodiments 3: The Embodiment is fulfilled by combination of two or more column separation units installed in series or parallel, the component units may be two or more of any kinds introduced in Embodiments 1 and 2. The specific feature of this apparatus and its process is that it takes a uniform feed and discharge passages for the whole separation system and apparatus. The combination in series is beneficial to increasing its separation efficiency and that in parallel to increasing its production capacity and decreasing its operation cost.

Progress in magnification of the production capacity is made in Embodiment 3, and a set of the 3.0×6.0 (m) cyclonic-static micro-bubble floatation bed can process about 450–500 $m^3$/h in pulp, or 40 t/h in dry slime.

Figure 1:
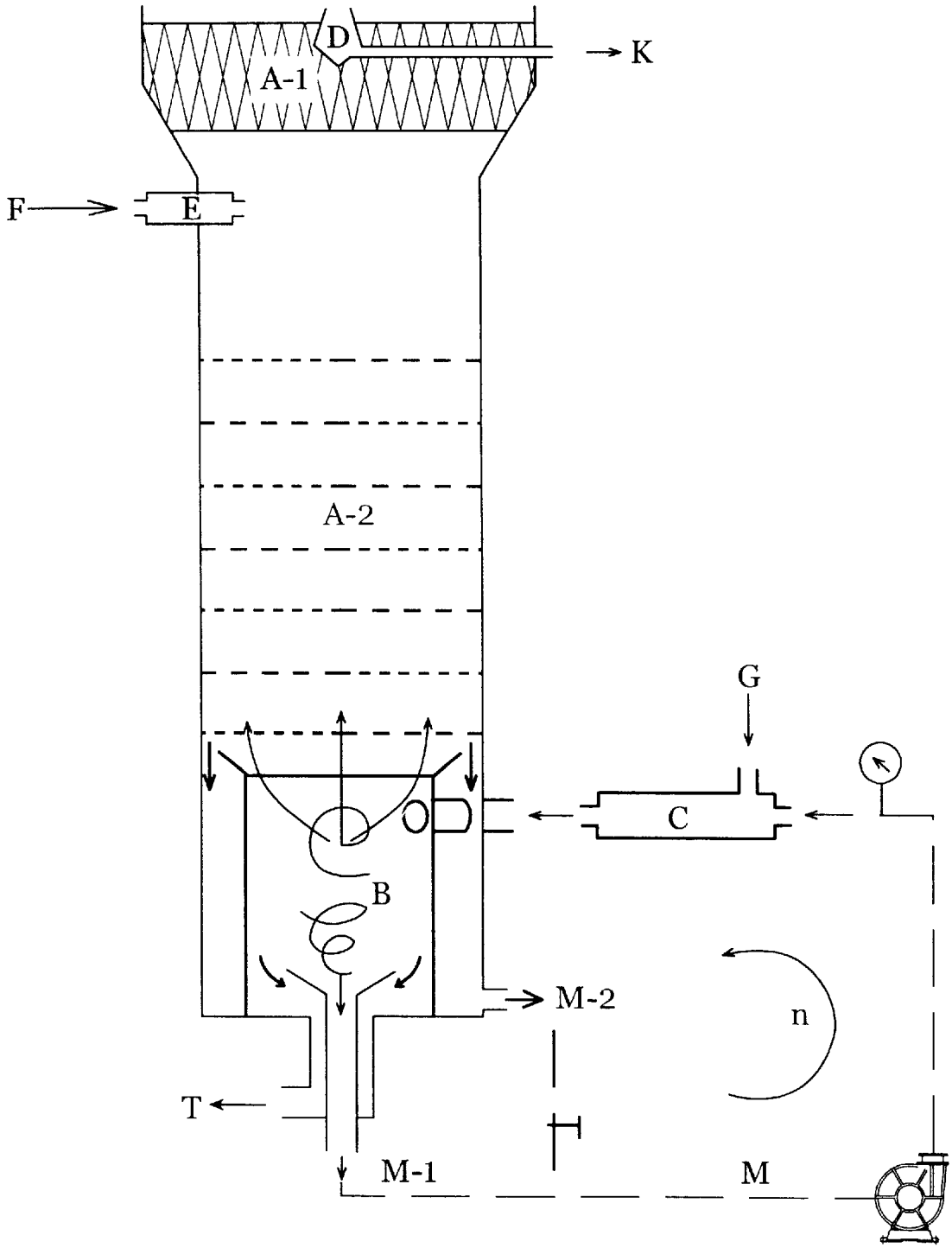
FIG. 1 is a schematic view of embodiment 1 of the present invention.
Figure 2:
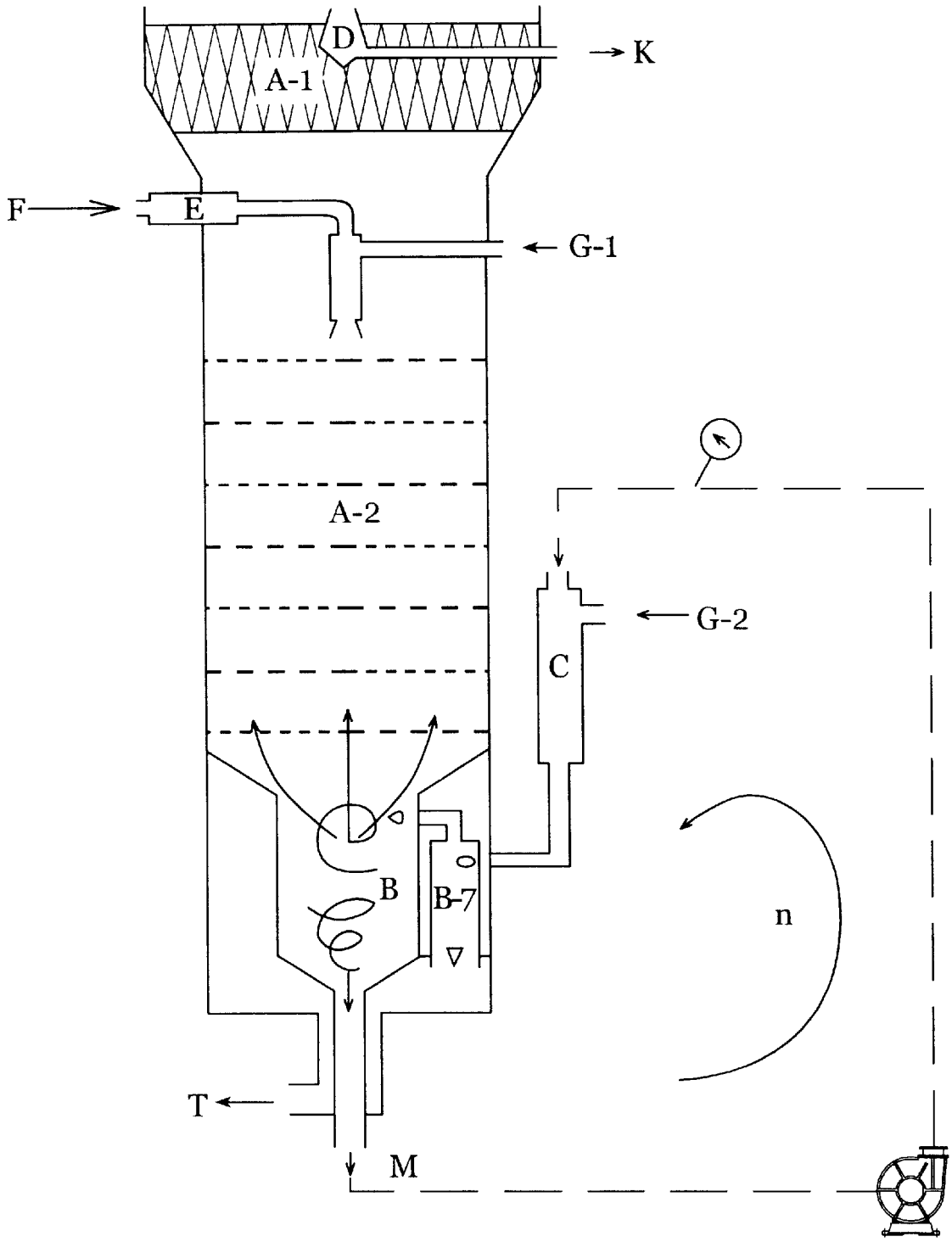
FIG. 2 is a schematic view of embodiment 2 of the present invention.

Above embodiments and apparatus involve a processing method for fine materials, that is, the floatation with cyclonic static micro-bubble floatation apparatus, which will be introduced referring to the schematic diagram of the cyclonic static micro-bubble floatation apparatus in FIGS. 1 and 2.

The separation process includes following procedures: grinding pulp; making pulp; distributing the mixture by the said feed distribution device directly or going through the feed pipe floatation device for primary separation and then into the column separator; coducting flotation within the column separator and cyclonic separation in the cyclonic separation device.

In the column separator, the pulp passes through several layers of tray plate fillers and flows in a zigzag pattern, resulting in collision with the lifting bubbles from the bottom of the column separator for mineralization. Then the mineralized bubbles (including that from the pipe floatation) pass the corrugated plate fillers and cumulate on the surface of the column separator to form a foam layer, which overflows into the foam collecting device as the end concentrate product.

In the cyclonic separation device, the pulp from the column separator is separated into three product pulps according to their density. The cyclonically separated middlings from the cyclonic separation device sometime with a part of the pulp from the column separator (refers to the floatation middlings) will be sent to the circulating pulp distribution tank after pressurization, and in the jet pipe flotation device undergo air suction, micro-bubble creation and mineralization in intense turbulent conditions, then be sent to the cyclonic separation device for its further processing. Therefore, a circular processing of the middlings is formed, that is, from the cyclonic separation to the jet pipe floatation then back to the cyclonic separation.

When the middlings is undergoing the circular processing, the overflow of the cyclonic separation enters the column separator and undergoes the floatation process, while the underflow of the cyclonic separation is discharged as the end tailings.

The cyclonic-state micro-bubble floatation method of the present invention may comprise more than one column separation unit connected in series or parallel, the said column separation unit consists of the above-mentioned floatation processing of the present invention.

The keys of this invented process are: column floatation improvement and its combination with cyclonic separation; combination of cyclonic separation and pipe floatation (the mechanism of cyclonic separation and pipe floatation); magnification of the cyclonic separation unit and the column separation unit.

The primary pipe floatation:

It includes following procedures: ore grinding, pulp mixing, pumping of the mixed pulp into the feed distribution tank, pulp distributing to the auto-suction micro-bubble generators, primary floatation in the feed jet pipe floatation device which consists of the auto-suction micro-bubble generators and the mineralization pipe segments. After completion of air suction, bubble creation and mineralization in intense turbulent conditions, the pulp enters into the column separation. The function of the primary pipe floatation is to recover the mineral with better floatability at the beginning of the process and, therefore, to increase the efficiency of the column separator.

The improvement of the column separation and its combination with the cyclonic separation:

The feed of the column separator is fresh pulp or the pulp after primary treatment by the feed pipe floatation. The feed enters the column separator after distributing by the feed distribution device, flowing downward evenly within its whole section and passing through the tray plate fillers, and in the same time the bubbles rise from the bottom of the column separator, resulting in continuing collision with the mineral particles and mineralization. Due to variation of the operture sizes and the opening factors of the tray plate fillers, both downward pulp and upward bubbles are influenced by an effect of so called "variation resistance", which may benefit for creation of a static "plugging" in a certain degree, leading the pulp flowing in zigzags and extending the pulp resident time in the column separator to improve the efficiency of collision and mineralization. Another benefit of the effect of the "variation resistance" is to promote distortion, disrupture and combination of the mineralized bubbles, which may play a good role in the processing. Packing with the corrugated plate fillers is beneficial to stabilization of the foam layer and improvement of the "secondary cumulation".

The material processed by the column separator flows downward into the cyclonic separation device for further processing, which is different from the conventional floatation columns.

The combination of cyclonic separation and pipe-floatation—the mechanism of intense processing with the cyclonic separation and pipe floatation:

The pump from the column separator will be divided into three pulp products according to their density, the pulp with a greater amount of the bubble flows upward into the column separator; the bubbles rise within it and begin the column floatation. When the apparatus is used for coal preparation, the pulp with middle density will be pumped as the circulating middlings into the jet pipe floatation device, after the pipe floatation, this pulp as feed comes back into the cyclonic separation device, forming a circulating links of the middlings processing, the circular processing will take 2~3 times. The pulp with high density minerals will be directly discharged as the end tailings.

Both the cyclonic separation and the pipe floatation are effective processing methods for fine materials with a high efficiency, and their combination to treat the pulp processed by the floatation column can increase the separation efficiency and recovery, and get tailings with higher ash content.

Magnification of the cyclonic separation unit and the column separation unit:

With increase of the production capacity of the apparatus, the diameter of the cyclonic separation device should be expended correspondingly, resulting in decrease of the vortex in the cyclonic devices which may worsen the processing within it. To solve this problem and ensure the high separation effectiveness, a combination of a central cyclonic separation device with bigger diameter and at least one outer ones with smaller diameter is adopted, that is, the pulp from the column separator after its processing enters the central cyclonic separation device to get the middlings, which is pressurized and passed through the pipe floatation device, then sent into the outer cyclonic separators of smaller diameter to get the end tailings, and the overflow of the outer cyclonic separators is sent back to the cyclonic separation device as their feed. Change from the single-cyclonic separation to the double-cyclonic separation provides the basic means for the magnification of the cyclonic static micro-bubble floatation apparatus.

Two kinds of the basic processing units, the single-cyclonic static micro-bubble floatation column unit and the double-cyclonic static micro-bubble floatation column unit serve the base of the apparatus construction. Their combination in series or parallel forms a set of the cyclonic static micro-bubble floatation bed, and its production capacity has no limit theoretically.

The different embodiment and method of the present invention are discribed above. It is obvious that various substitutions, modifications and changes from the teachings of the present invention may be contemplated by those skilled in the art without departing from the intended spirit and scope thereof. It is intended that the present invention only be limited by the terms of the appended claims.

What is claimed is:

1. A cyclonic static micro-bubble floatation apparatus, comprising:

a column separator; and a foam collecting device and a feed distribution device both installed at the upper portion of the column separator;

the said column separator includes a column and packing media within it; the column comprises an upper shell, a lower shell, a horn shaped linking section connecting with the upper shell and the lower shell, and a bottom plate;

the said foam collecting device includes a foam collecting tank, a foam storage tank and at least one linking and supporting pipe between the two tanks;

the said feed distribution device includes a feed distribution tank and at least one feed pipe connecting with the column separator, the feed distribution tank is installed at the upper portion of the column separator;

two kinds of fillers are used for the said packing media of the column separator, wherein corrugated plate fillers used in the upper space above the feed pipe and tray plate fillers of at least one layer used in the lower space under the feed pipe, and on the tray plate fillers have at least two regions with different operture sizes and opening factors, which are disposed in the way of alternating arrangement;

the floatation apparatus further comprises a cyclonic separation device provided on the bottom plate; the said cyclonic separation device includes a cylindrical cyclonic shell and a horn shaped section fixed on the upper of the cyclonic shell; the inside of the horn shaped section forms a passage connecting the cyclonic separation device with the column separator, and the circular section between its outside and the inner wall of the lower shell forms an entrance of a discharge passage M-2;

a hole is provided at the center of the bottom plate, and a cyclonic reverse cone is installed on the bottom plate to divide the said hole into two discharge passages, a lower density material discharge passage M-1 and a higher density material discharge passage T; on the inner wall of the cyclonic shell at least one spiral leading plate is provided;

on the outside of the lower shell a jet pipe floatation device is provided, which includes a circulating pulp distribution tank, at least one auto-suction micro-bubble generator and at least one mineralization pipe segment connected with the said generator; the circulating pulp distribution tank is installed at the upper-middle portion of the outside of the lower shell; the upper ends of the auto-suction micro-bubble generator and the mineralization pipe segment are connected with the circulating pulp distribution tank, and the lower ends are horizontally passed through the lower shell and tangentially connected with the cylindrical cyclonic shell; an air pipe of the auto-suction micro-bubble generator is connected with a leading pipe lengthened to the upper end of the column separator, forming the air suction passage G; two discharge passages M-1 and M-2 are connected with the circulating pulp distribution tank of the jet pipe floatation device, and the outlet of the jet pipe floatation device is tangentially connected with the cyclonic separation device, forming the circulating passage of middlings' pipe floatation.

2. A cyclonic static micro-bubble floatation apparatus according to claim 1, wherein the said upper shell is occupied by the cleaning zone of the column separation, whose section area is greater than that of the said lower shell, the upper shell and the lower shell are connected with the horn shaped linking section.

3. A cyclonic static micro-bubble floatation apparatus according to claim 1, wherein the said tray plate filler is be a flat perforated plate, or a combination of a flat perforated plate and a supporting perforated plate; the flat perforated plate has at least two regions with different operture sizes and opening factors, which are disposed in the way of alternating arrangement; the supporting perforated plate is fixed under the flat perforated plate in radial direction along the border between two regions with different operture sizes, whose highness is corresponding to the support distance.

4. A cyclonic static micro-bubble floatation apparatus according to claim 3, wherein in the said column separator the tray plate fillers are packed in such way that the regions with same operture sizes and opening factors of different fillers are disposed in an alternating arrangement without strict requirement for the number of tray plate fillers in a unit of the vertical section, to obtain a zigzag pattern of fluid flowing within the packing zones.

5. A cyclonic static micro-bubble floatation apparatus according to claim 1, wherein the said discharge passage M-2 includes at least one inner leading pipe, at least one vertical spacing plate and one horizontal annular distribution plate; the spacing plate divides the space under the horizontal annular distribution plate into at least two parts, forming at least two annular discharge passages through the holes on the horizontal annular distribution plate, and the inner leading pipe(s) collects the pulp discharged from all annular discharge passages and transit it into a outer discharge pipe forming a whole discharge passage for the middlings.

6. A cyclonic static micro-bubble floatation apparatus according to claim 1, wherein diameter ratio of the upper end opening of the said cyclonic reverse cone to the cyclonic shell is within the range of 0.5 to 0.9, and the lower section of the cyclonic shell is divided by the upper end opening of the said cyclonic reverse cone into two pulp passages; M-1 passage is formed by the inner side of the cyclonic reverse cone, the inner part of the hole of the bottom plate and a supporting and leading pipe connected with them; and T passage is formed by the annular seam of the outside of the cyclonic reverse cone, the outer part of the hole of the bottom plate, and a collecting discharge tank connected with them.

7. A cyclonic static micro-bubble floatation apparatus according to claim 1, wherein on the inside wall of the said cyclonic shell at least one spiral leading plate is provided, forming a passage downwards along the said wall for the pulp with high density.

8. A cyclonic static micro-bubble floatation apparatus according to claim 1, wherein the said auto-suction micro-bubble generator includes an upper jacket and a lower jacket fixed together by bolts; the upper jacket is stair-like, within which a nozzle with at least one opening is provided and fixed by bolts; on its stair-like periphery air pipes are disposed; the lower jacket is a straight pipe, within which an end cap of a throat pipe, a throat pipe and a diffusion pipe are nested in order; the openings of the end cap of the throat pipe, the throat pipe and the diffusion pipe are a reverse cone shaped cylindrical and horn shaped respectively; the number of the opening at the end cap of the throat pipe, the throat pipe, the diffusion pipe and the nozzle is the same, at least one, forming at least one jet air-suction unit space arranged along the axis direction; the mineralization pipe segment is connected with the outlet of the auto-suction micro-bubble generator, whose length is no less than 1.5 m.

9. A cyclonic static micro-bubble floatation apparatus according to claim 1, wherein the sectional shape of the said foam collecting tank is ship shaped, its upper opening forms inner and outer foam overflow weirs within the upper shell and its bottom is connected with a linking and supporting pipe to discharge the foam product.

10. A cyclonic static micro-bubble floatation apparatus, comprising:

a column separator; and a foam collecting device and a feed distribution device both installed at the upper portion of the column separator;

the said column separator includes a column and packing media within it; the column comprises an upper shell, a lower shell, a horn shaped linking section connected with the upper shell and the lower shell, and a bottom plate; the said foam collecting device includes a foam collecting tank, a foam storage tank and at least one linking and supporting pipe between the two tanks wherein the said feed distribution device includes a feed distribution tank and at least one auto-suction micro-bubble generator and at least one mineralization pipe segment connected with the above generator to form the feed pipe floatation device; the upper portion of the feed pipe floatation device is connected with the feed distribution tank, an air pipe of the auto-suction micro-bubble generator is connected with a leading pipe lengthened to the upper end of the column separator, forming an air suction passage G-1;

two kinds of fillers are used for the said column separator packing media, corrugated plate fillers used in the upper space above the feed pipe and tray plate fillers of at least one layer used in the lower space under the feed pipe, and in the tray plate fillers have at least two regions with different operture sizes and opening factors, which are disposed in the way of alternating arrangement;

the floatation apparatus further comprises a cyclonic separation device provided on the bottom plate; the said cyclonic separation device includes a cylindrical cyclonic shell, a horn shaped section connected with the cyclonic shell and the lower shell, and a cyclonic reverse cone; the said cyclonic reverse cone is located at the central of the bottom plate, connected with the supporting and leading pipe to form a discharge passage M for the low density material; around the cyclonic separation device at least one outer cyclonic separator is provided, its overflow opening is tangentially connected with the cyclonic shell and is functioned as a feed passage, and a collection and discharge passage T for the high density material is formed by the outside of the cyclonic reverse cone and a collecting discharge tank, on the inner wall of the cyclonic shell at least one spiral leading plate is fixed;

on the outside of the lower shell a jet pipe floatation device is provided, which includes a circulating pulp distribution tank, at least one auto-suction micro-bubble generator and at least one mineralization pipe segment connected with the said generator; the circulating pulp distribution tank is installed at the upper-middle portion of the outside of the lower shell; the upper ends of the auto-suction micro-bubble generator and the mineralization pipe segment are connected with the circulating pulp distribution tank, and the lower ends are horizontally passed through the lower shell and tangentially connected with the at least one outer cyclonic separator; an air pipe of the auto-suction micro-bubble generator is connected with a leading pipe lengthened to the upper end of the column separator, forming the air suction passage G-2; the discharge passages M is connected with the circulating pulp distribution tank of the jet pipe floatation device and the outlet of the jet pipe floatation device is tangentially connected with the at least one outer cyclonic separator, forming the circulating passage of middlings' pipe floatation.

11. A cyclonic static micro-bubble floatation apparatus according to claim 10, wherein the said upper shell is occupied by the cleaning zone of the column separation, whose section area is greater than that of the said lower shell, the upper shell and the lower shell are connected with the horn shaped linking section.

12. A cyclonic static micro-bubble floatation apparatus according to claim 10, wherein the said tray plate filler is a flat perforated plate, or a combination of a flat perforated plate and a supporting perforated plate; the said flat perforated plate has at least two regions with different operture sizes and opening factors, which are disposed in the way of alternating arrangement; the supporting perforated plate is fixed under the flat perforated plate in radial direction along the border between two regions with different operture sizes, whose highness is corresponding to the support distance.

13. A cyclonic-static micro-bubble floatation apparatus according to claim 12, wherein in the said column separator the said tray plate fillers are packed in such way that the regions with same operture sizes and opening factors of different fillers are disposed in an alternating arrangement without strict requirement for the number of tray plate fillers in a unit of the vertical section, to obtain a zigzag pattern of fluid flowing within the packing zones.

14. A cyclonic-static micro-bubble floatation apparatus according to claim 10, wherein on the inside wall of the said cyclonic shell at least one spiral leading plate is provided, forming a passage downwards along the said wall for the pulp with high density.

15. A cyclonic-static micro-bubble floatation apparatus according to claim 10, wherein the shape of the outer cyclonic separator is cylindrical, and inside its underflow opening an inner cyclonic reverse cone is provided to form an annular discharge passage for the underflow.

16. A cyclonic-static micro-bubble floatation apparatus according to claim 10, wherein the said auto-suction micro-bubble generator includes an upper jacket and a lower jacket fixed together by bolts; the upper jacket is stair-like, within which a nozzle with at least one opening is provided and fixed by bolts; on its stair-like periphery air pipes are disposed, the lower jacket is a straight pipe, within which an end cap of a throat pipe, a throat pipe and a diffusion pipe are nested in order; the openings of the end cap of the throat pipe, the throat pipe and the diffusion pipe are adverse cone shaped cylindrical and horn shaped respectively; the number of the opening at the end cap of the throat pipe, the throat pipe, the diffusion pipe and the nozzle is the same, at least one, forming at least one jet air-suction unit space arranged along the axis direction; the mineralization pipe segment is connected with the outlet of the auto-suction micro-bubble generator, said mineralization pipe segment has a length which is no less than 1.5 m.

17. A cyclonic-static micro-bubble floatation apparatus according to claim 10, wherein the said section shape of the said foam collecting tank is ship shaped, which upper opening forms inner and outer foam overflow weirs in the upper shell and which bottom is connected with a linking and supporting pipe to discharge the foam product.

18. A cyclonic static micro-bubble floatation apparatus, comprising:

a column separator; and a foam collecting device and a feed distribution device both installed at the upper portion of the column separator;

the said column separator includes a column and packing media within it; the column comprises an upper shell, a lower shell, a horn shaped linking section connecting with the upper shell and the lower shells, and a bottom plate;

the said foam collecting device includes a foam collecting tank, wherein a foam storage tank and at least one linking and supporting pipe between the two tanks;

the said feed distribution device includes a feed distribution tank and at least one auto-suction micro-bubble generator and at least one mineralization pipe segment connected with the above generator to form the feed pipe floatation device; the upper portion of the feed pipe floatation device is connected with the feed distribution tank, an air pipe of the auto-suction micro-bubble generator is connected with a leading pipe lengthened to the upper end of the column separator, forming the air suction passage G-1;

two kinds of fillers are used for the said column separator packing media, corrugated plate fillers used in the upper space above the feed pipe and tray plate fillers with at least one layer used in the lower space under the feed pipe; and the tray plate fillers have at least two regions with different operture sizes and opening factors, which are disposed in the way of alternating arrangement;

a group of cyclonic separation device is provided at the bottom plate, which includes at least two cyclonic separation units, and every cyclonic separation unit includes one cyclonic separation device and at least one outer cyclonic separator arranged around each cyclonic separation device; the cyclonic separation device comprises a cylindrical cyclonic shell; a horn shaped section connecting with the cyclonic shell and the lower shell or a unit spacing plate, and a cyclonic reverse cone; the cyclonic reverse cone is connected with the supporting and leading pipe via a circular hole in the bottom plate to form a discharge passage M for the material of low density; the overflow opening of the outer cyclonic separator is tangentially connected with the cyclonic shell to form the feed entrance for each cyclonic separation device; and the collection and discharge passage T for the underflow pulp of high density is formed by a discharge reverse cone, the cyclonic reverse cone, a annular hole around the said hole in the bottom plate and a collecting discharge tank; on the inner wall of the cyclonic shell at least one spiral leading plate is fixed; corresponding to each cyclonic separation unit, the said unit spacing plate is installed at the upper end of two neighbor horn shaped sections; on the outer side of the lower shell a jet pipe floatation device is provided, which includes a circulating pulp distribution tank, at least one auto-suction micro-bubble generator and at least one mineralization pipe segment connected with the said generator; the circulating pulp distribution tank is installed at the upper-middle portion of the outside of the lower shell; the upper ends of the auto-suction micro-bubble generator and the mineralization pipe segment are connected with the circulating pulp distribution tank, and the lower ends are horizontally passed through the lower shell and tangentially connected with the at least one outer cyclonic separator, an air pipe of the auto-suction micro-bubble generator is connected with a leading pipe lengthened to the upper end of the column separator, forming the air suction passage G-2; the discharge passages M of all cyclonic separation units join to form the middlings discharge passage which is connected with the circulating pulp distribution tank of the jet pipe floatation device, and the outlet of the jet pipe floatation device is tangentially connected with the at least one outer cyclonic separator, forming the circulating passage of middlings' pipe floatation.

19. A cyclonic static micro-bubble floatation apparatus according to claim 18, wherein the said upper shell is occupied by the cleaning zone of the column separation, whose section area is greater than that of the said lower shell, the upper and lower shells are connected with the horn shaped linking section.

20. A cyclonic static micro-bubble floatation apparatus according to claim 18, wherein the said tray plate filler is a flat perforated plate, or a combination of a flat perforated plate and a supporting perforated plate; the flat perforated plate has at least two regions with different sieve sizes and opening factors, which are disposed in the way of alternating arrangement; the supporting perforated plate is fixed under the flat perforated plate in radial direction along the border between two regions with different operture sizes, which highness is corresponding to the support distance.

21. A cyclonic static micro-bubble floatation apparatus according to claim 18, wherein in the said column separator the said tray plate fillers are packed in such way that the regions with different operture sizes and opening factors of different fillers are disposed in an alternating arrangement, resulting in a zigzag pattern of fluid flowing within the packing zones.

22. A cyclonic static micro-bubble floatation apparatus according to claim 18, wherein on the inside wall of the said cyclonic shell at least one spiral leading plate is provided, forming a passage downwards along the said wall for the pulp with high density.

23. A cyclonic static micro-bubble floatation apparatus according to claim 18, wherein the shape of the outer cyclonic separator is cylindrical, and inside its underflow opening the discharge cyclonic reverse cone is provided to form an annular discharge passage for the underflow.

24. A cyclonic static micro-bubble floatation apparatus according to claim 18, wherein the said auto-suction micro-bubble generator includes an upper jacket and a lower jacket fixed together by bolts; the upper jacket is stair-like, within which a nozzle with at least one opening is provided and fixed by bolts; on its stair-like periphery air pipes are disposed; the lower jacket is a straight pipe, within which an end cap of a throat pipe, a throat pipe and a diffusion pipe are nested in order; the openings of the end cap of the throat pipe, the throat pipe and the diffusion pipe are adverse cone shaped, cylindrical and horn shaped respectively; the number of the opening at the end cap of the throat pipe, the throat pipe, the diffusion pipe and the nozzle is the same, at least one, forming at least one jet air-suction unit space arranged along the axis direction; the mineralization pipe segment is connected with the outlet of the auto-suction micro-bubble generator, said mineralization pipe segment has a length which is no less than 1.5 m.

25. A cyclonic static micro-bubble floatation apparatus according to claim 18, wherein the said sectional shape of the said foam collecting tank is ship shaped, which upper opening forms inner and outer foam overflow weirs in the upper shell and which bottom is connected with a linking and supporting pipe to discharge the foam product.

26. A cyclonic static micro-bubble floatation apparatus according to claim 18, wherein at the upper ends of two neighbor horn shaped sections a unit spacing plate is provided, which upper level should not exceed that of the lower level of the mineralization pipe segment of the feed distribution device.

* * * * *